US012359808B1

(12) United States Patent
Baker et al.

(10) Patent No.: US 12,359,808 B1
(45) Date of Patent: Jul. 15, 2025

(54) VARIABLE FUEL COOKER

(71) Applicant: GMG Products, LLC, Lakeside, OR (US)

(72) Inventors: David W. Baker, Lakeside, OR (US); Jason Baker, Scottsdale, AZ (US); Wang Ping, Wuhan (CN)

(73) Assignee: GMG Products, LLC, Lakeside, OR (US)

( * ) Notice: Subject to any disclaimer, the term of this patent is extended or adjusted under 35 U.S.C. 154(b) by 0 days.

(21) Appl. No.: 18/946,801

(22) Filed: Nov. 13, 2024

Related U.S. Application Data

(60) Provisional application No. 63/640,706, filed on Apr. 30, 2024.

(51) Int. Cl.

| | |
|---|---|
| ***F23N 1/02*** | (2006.01) |
| ***F23K 3/00*** | (2006.01) |
| ***F24B 13/04*** | (2006.01) |

(52) U.S. Cl.
CPC ..... *F23N 1/025* (2013.01); *F23K 3/00* (2013.01); *F24B 13/04* (2013.01); *F23K 2203/202* (2013.01); *F23N 2225/08* (2020.01)

(58) Field of Classification Search
None
See application file for complete search history.

(56) References Cited

U.S. PATENT DOCUMENTS

| | | | |
|---|---|---|---|
| 100,410 | A | 3/1870 | Hull |
| 103,736 | A | 5/1870 | Gregory |

(Continued)

FOREIGN PATENT DOCUMENTS

| | | | |
|---|---|---|---|
| AT | 411098 | | 9/2003 |
| CN | 201794520 | U * | 4/2011 |

(Continued)

OTHER PUBLICATIONS

International Search Report and Written Opinion of the International Searching Authority mailed Nov. 27, 2024, in International Patent Application No. PCT/US2024/044927, 13 pages.

(Continued)

*Primary Examiner* — Jason Lau
(74) *Attorney, Agent, or Firm* — Lowe Graham Jones PLLC

(57) ABSTRACT

An improved auger system for delivering combustible material to a burn box within a cooker, such as a grill or smoker, uses a pivotable coupling between the auger shaft and the drive motor, enabling the auger to adjust its alignment within the tube to accommodate irregularly shaped materials, thus minimizing jamming and improving the consistency of material delivery. The system also incorporates a mechanism to prevent material bridging in the hopper, ensuring the continuous flow of material into the auger tube as well as an auger cover flap pivotably mounted at the outlet end of an auger tube. A programmable controller allows users to select between variable combustible materials and regulate grill systems, allowing adjustment of cooker elements including the auger, airflow fans, and a hopper agitator to optimize combustion efficiency and maintain consistent cooking temperatures, adapting to the characteristics of each fuel type.

14 Claims, 11 Drawing Sheets

(56) References Cited

U.S. PATENT DOCUMENTS

| | | | |
|---|---|---|---|
| 119,169 | A | 9/1871 | Ogden |
| 161,577 | A | 3/1875 | Thomas |
| 382,886 | A | 5/1888 | Lee |
| 1,038,420 | A | 9/1912 | Newcomer et al. |
| 1,433,062 | A | 10/1922 | Bellamy |
| RE16,011 | E | 3/1925 | Simon |
| 1,650,634 | A | 11/1927 | Lutzler |
| 1,755,674 | A | 4/1930 | Tauriainen |
| 1,919,407 | A | 7/1933 | Wood |
| 1,938,565 | A | 12/1933 | Anderson |
| 1,960,778 | A | 5/1934 | Goss et al. |
| 2,068,018 | A | 1/1937 | Goetz |
| 2,354,240 | A | 7/1944 | Young et al. |
| 2,365,679 | A | 12/1944 | Casey |
| 2,620,970 | A | 12/1952 | Palmer et al. |
| 2,641,085 | A | 6/1953 | Robinson et al. |
| 2,833,363 | A | 5/1958 | Henehan |
| 2,997,566 | A | 8/1961 | Pierce et al. |
| 3,021,386 | A | 2/1962 | Clark |
| 3,073,263 | A | 1/1963 | Wynkoop |
| 3,307,506 | A | 3/1967 | Rose |
| 3,327,698 | A | 6/1967 | Leslie |
| 3,384,066 | A | 5/1968 | Tufts |
| 3,413,935 | A | 12/1968 | Behrns |
| 3,453,975 | A | 7/1969 | Gunter |
| 3,474,725 | A | 10/1969 | McClaren |
| 3,586,518 | A | 6/1971 | Folmar |
| 3,600,969 | A | 8/1971 | Pitner |
| 3,609,236 | A | 9/1971 | Heilman |
| 3,739,732 | A | 6/1973 | Graham |
| 3,742,839 | A | 7/1973 | Maley |
| 3,745,303 | A | 7/1973 | Epperson et al. |
| 3,765,397 | A | 10/1973 | Henderson |
| 3,814,005 | A | 6/1974 | Widdel |
| 3,838,249 | A | 9/1974 | Detterbeck |
| 3,903,866 | A | 9/1975 | Polinski |
| 3,934,520 | A | 1/1976 | Brennan et al. |
| 4,020,322 | A | 4/1977 | Muse |
| 4,094,295 | A | 6/1978 | Boswell et al. |
| 4,094,649 | A | 6/1978 | Osterried |
| 4,227,510 | A | 10/1980 | Frazier et al. |
| 4,241,650 | A | 12/1980 | John et al. |
| 4,334,462 | A | 6/1982 | Hefling |
| 4,374,489 | A | 2/1983 | Robbins |
| 4,395,958 | A | 8/1983 | Caffyn et al. |
| 4,401,017 | A | 8/1983 | Feld |
| D270,987 | S | 10/1983 | Scheufler |
| 4,413,609 | A | 11/1983 | Tisdale |
| 4,417,565 | A | 11/1983 | Karpinia |
| 4,454,805 | A | 6/1984 | Matthews |
| 4,481,408 | A | 11/1984 | Scheufler |
| 4,491,722 | A | 1/1985 | Fischer et al. |
| 4,495,860 | A | 1/1985 | Hitch et al. |
| 4,503,835 | A | 3/1985 | Williams |
| 4,508,094 | A | 4/1985 | Hait |
| 4,509,412 | A | 4/1985 | Whittenburg et al. |
| 4,510,916 | A | 4/1985 | Ogden |
| 4,512,249 | A | 4/1985 | Mentzel |
| 4,531,505 | A | 7/1985 | Hait et al. |
| 4,531,507 | A | 7/1985 | Gerson |
| 4,539,973 | A | 9/1985 | Hait |
| 4,554,864 | A | 11/1985 | Smith et al. |
| 4,574,776 | A | 3/1986 | Hidle |
| 4,587,947 | A | 5/1986 | Tomita |
| 4,591,698 | A | 5/1986 | Chang |
| 4,603,679 | A | 8/1986 | Ogden |
| 4,624,238 | A | 11/1986 | Hait |
| 4,626,352 | A | 12/1986 | Massey et al. |
| 4,628,351 | A | 12/1986 | Heo |
| 4,638,787 | A | 1/1987 | Tyson |
| 4,706,643 | A | 11/1987 | Tyson |
| 4,711,979 | A | 12/1987 | Glasser et al. |
| 4,714,013 | A | 12/1987 | Telfer |
| 4,721,037 | A | 1/1988 | Blosnich |
| 4,762,056 | A | 8/1988 | Virag |
| 4,788,905 | A | 12/1988 | Von Kohorn |
| 4,803,921 | A | 2/1989 | Nuss |
| 4,867,050 | A | 9/1989 | Patenaude et al. |
| 4,877,010 | A | 10/1989 | Hait |
| 4,909,235 | A | 3/1990 | Boetcker |
| 4,909,237 | A | 3/1990 | Karpinia |
| 4,910,372 | A | 3/1990 | Vukich |
| 4,938,202 | A | 7/1990 | Hait |
| 4,958,578 | A | 9/1990 | Houser |
| 4,962,696 | A | 10/1990 | Gillis |
| 4,976,252 | A | 12/1990 | Cianciola |
| 4,987,827 | A | 1/1991 | Marquez |
| 5,070,777 | A | 12/1991 | Novak |
| 5,086,752 | A | 2/1992 | Hait |
| 5,094,223 | A | 3/1992 | Gonzalez |
| 5,094,280 | A | 3/1992 | Kahilahti et al. |
| 5,097,817 | A | 3/1992 | Dodgen |
| 5,123,360 | A | 6/1992 | Burke et al. |
| 5,154,159 | A | 10/1992 | Knafelc et al. |
| 5,167,183 | A | 12/1992 | Schlosser et al. |
| 5,168,796 | A | 12/1992 | Porton et al. |
| 5,172,682 | A | 12/1992 | Luebke et al. |
| 5,176,067 | A | 1/1993 | Higgins |
| 5,176,124 | A | 1/1993 | Wrasse |
| 5,185,047 | A | 2/1993 | Ray |
| D333,941 | S | 3/1993 | Hait |
| 5,195,423 | A | 3/1993 | Beller |
| 5,197,379 | A | 3/1993 | Leonard, Jr. |
| 5,197,455 | A | 3/1993 | Tessien |
| 5,218,950 | A | 6/1993 | Hait |
| 5,253,634 | A | 10/1993 | LeBeouf |
| 5,269,286 | A | 12/1993 | Cowan |
| 5,276,307 | A | 1/1994 | Higgins |
| 5,287,799 | A | 2/1994 | Pickering et al. |
| 5,313,877 | A | 5/1994 | Holland |
| D347,548 | S | 6/1994 | Boehm et al. |
| 5,359,988 | A | 11/1994 | Hait |
| 5,425,352 | A | 6/1995 | Gillam et al. |
| 5,437,222 | A | 8/1995 | Franklin |
| 5,469,835 | A | 11/1995 | Stephen et al. |
| 5,473,980 | A | 12/1995 | Carpenter |
| 5,495,845 | A | 3/1996 | Hait |
| 5,516,009 | A | 5/1996 | Kautz |
| 5,517,902 | A | 5/1996 | Boston |
| 5,524,610 | A | 6/1996 | Clark |
| 5,528,984 | A | 6/1996 | Saurwein |
| D376,510 | S | 12/1996 | Ting |
| 5,586,488 | A | 12/1996 | Liu |
| 5,605,092 | A | 2/1997 | Riccio |
| 5,617,778 | A | 4/1997 | Schroeter et al. |
| D379,900 | S | 6/1997 | Gillam et al. |
| 5,649,477 | A | 7/1997 | Lingwood |
| 5,655,435 | A | 8/1997 | Rachesky |
| 5,687,704 | A | 11/1997 | Lerch et al. |
| 5,775,315 | A | 7/1998 | Baykal |
| 5,797,386 | A | 8/1998 | Orr |
| 5,809,871 | A | 9/1998 | Arathoon |
| 5,809,991 | A | 9/1998 | Pai |
| 5,821,507 | A | 10/1998 | Sasaki et al. |
| 5,884,006 | A | 3/1999 | Frohlich et al. |
| 5,891,498 | A | 4/1999 | Boehler |
| D411,407 | S | 6/1999 | Anthony |
| 5,957,038 | A | 9/1999 | Shimazaki |
| 6,035,770 | A | 3/2000 | Whitefield |
| 6,055,901 | A | 5/2000 | Gantos et al. |
| 6,058,832 | A | 5/2000 | Fountain |
| 6,065,464 | A | 5/2000 | Zajec |
| 6,065,466 | A | 5/2000 | Baykal |
| 6,076,515 | A | 6/2000 | Smith |
| 6,097,004 | A | 8/2000 | Seul |
| 6,103,291 | A | 8/2000 | Fernandez Tapia |
| 6,108,489 | A | 8/2000 | Frohlich et al. |
| 6,125,740 | A | 10/2000 | Hedrington et al. |
| 6,161,534 | A | 12/2000 | Kronman |
| 6,167,799 | B1 | 1/2001 | Macias |
| 6,176,173 | B1 | 1/2001 | Holbrook et al. |
| 6,187,359 | B1 | 2/2001 | Zuccarini |
| D439,792 | S | 4/2001 | Hedrington et al. |
| 6,213,006 | B1 | 4/2001 | Reardon et al. |

(56) References Cited

U.S. PATENT DOCUMENTS 6,223,737 B1 5/2001 Buckner
6,229,563 B1 5/2001 Miller, II et al.
6,263,786 B1 7/2001 Raio et al.
6,289,795 B1 9/2001 McLemore et al.
6,307,193 B1 10/2001 Toole
6,314,868 B1 11/2001 Christensen et al.
6,314,869 B1 11/2001 Bourgeois, Jr.
6,425,388 B1 7/2002 Korinchock
6,467,400 B2 10/2002 Raio et al.
6,523,463 B1 2/2003 Hogle
6,525,299 B2 2/2003 Hannon et al.
6,546,849 B1 4/2003 Shimazaki
6,568,314 B1 5/2003 Stepanova
6,640,695 B2 11/2003 Stark
6,675,794 B1 1/2004 Yang
6,688,301 B1 2/2004 McNeill
6,874,495 B2 4/2005 McFadden
6,874,496 B2 4/2005 Waits et al.
7,021,202 B2 4/2006 Sizer
7,101,583 B1 9/2006 Bove
7,107,983 B1 9/2006 West
7,312,424 B2 12/2007 Hannon et al.
7,337,712 B1 3/2008 Wang et al.
7,449,665 B2 11/2008 Fadelli et al.
7,467,718 B1 12/2008 Donohue
7,575,002 B2 8/2009 DeMars et al.
7,681,493 B2 3/2010 Moore
7,685,931 B2 3/2010 Rivera
7,686,010 B2 3/2010 Gustavsen
D623,013 S 9/2010 Alden et al.
D624,781 S 10/2010 Allen et al.
7,832,330 B1 11/2010 Thompson
7,900,553 B1 3/2011 Maurin
7,900,624 B2 3/2011 DeMars et al.
D640,896 S 7/2011 Molayem
D642,421 S 8/2011 Difante
8,067,716 B1 11/2011 Lloyd
D653,074 S 1/2012 Difante
D658,424 S 5/2012 Difante
D658,425 S 5/2012 Difante
8,181,640 B2 5/2012 Park
8,291,896 B1 10/2012 Gonnella et al.
8,365,717 B1 2/2013 Perry
D687,257 S 8/2013 DiFante
8,578,927 B2 11/2013 Gustavsen
8,651,018 B1 2/2014 Loud, III
8,662,069 B2 3/2014 Gasparini et al.
8,662,070 B2 3/2014 Johnston
8,720,322 B2 5/2014 West
D707,075 S 6/2014 Fung
8,752,479 B2 6/2014 Sacherman et al.
8,763,519 B2 7/2014 Ricchio et al.
8,826,806 B2 9/2014 Difante
9,003,962 B2 4/2015 Broerman
D733,483 S 7/2015 Baker et al.
9,182,129 B2 11/2015 Dahle et al.
9,226,343 B2 12/2015 Moon et al.
D748,424 S 2/2016 Funnell, II et al.
9,504,352 B2 11/2016 Lin
D782,864 S 4/2017 Bhogal et al.
D784,730 S 4/2017 Kruger
D784,759 S 4/2017 Nadal
D786,014 S 5/2017 Knight
9,635,979 B2 5/2017 Abrams et al.
9,644,847 B2 5/2017 Bhogal et al.
9,668,615 B2 6/2017 Contarino, Jr.
9,702,563 B2 7/2017 Probst et al.
9,718,220 B1 8/2017 Claridge Huggins
D802,996 S 11/2017 Bhogal et al.
9,848,731 B2 12/2017 Dahle et al.
9,879,435 B2 1/2018 Kruger et al.
D812,973 S 3/2018 Nadal
9,927,129 B2 3/2018 Bhogal et al.
9,970,661 B2 5/2018 Calvin
10,021,889 B2 7/2018 Vinett
10,024,544 B2 7/2018 Bhogal et al.
10,058,172 B2 8/2018 Staib
D828,713 S 9/2018 Correa
D844,961 S 4/2019 Toms, Jr. et al.
10,292,531 B1 5/2019 Hancock et al.
D861,409 S 10/2019 Bhogal et al.
10,523,851 B2 12/2019 Armstrong
10,674,569 B2 6/2020 Luckhardt et al.
10,778,876 B2 9/2020 Goettlein
D901,244 S 11/2020 Baker et al.
D921,413 S 6/2021 Fitzpatrick
11,166,590 B2 11/2021 Zheng
2002/0017290 A1 2/2002 Hines, Jr.
2002/0069764 A1 6/2002 Cohen
2002/0166460 A1 11/2002 O'Shea
2003/0001721 A1 1/2003 Daum et al.
2003/0096159 A1 5/2003 Suzuki
2004/0020482 A1 2/2004 Chen
2004/0025862 A1 2/2004 Lor et al.
2004/0094142 A1 5/2004 Christensen et al.
2004/0154611 A1 8/2004 Beech
2004/0226454 A1 11/2004 Pirkle et al.
2004/0255926 A1 12/2004 Waits et al.
2005/0098168 A1 5/2005 Williams et al.
2005/0205076 A1 9/2005 Boucher
2006/0042475 A1 3/2006 Craig
2006/0102167 A1 5/2006 Driscoll, Jr.
2006/0124120 A1 6/2006 Gross
2006/0225580 A1 10/2006 Fernandez et al.
2006/0236995 A1 10/2006 Chang
2006/0260603 A1 11/2006 Shah
2007/0006863 A1 1/2007 Barbarich
2007/0108177 A1 5/2007 Engelhardt
2007/0169636 A1 7/2007 Carlson et al.
2007/0221191 A1 9/2007 O'Brien et al.
2007/0246453 A1 10/2007 Nam et al.
2007/0277800 A1 12/2007 Chiang
2008/0000467 A1 1/2008 Dudley et al.
2008/0047540 A1 2/2008 Hoffman et al.
2008/0085172 A1 4/2008 Harman et al.
2008/0196708 A1 8/2008 Lee
2008/0230043 A1 9/2008 Bruno
2008/0247313 A1 10/2008 Nath et al.
2009/0004348 A1 1/2009 Silva
2009/0013985 A1* 1/2009 Little ..... F23K 3/14 237/2 A
2009/0064985 A1 3/2009 Gustavsen
2009/0078246 A1 3/2009 Leavens et al.
2009/0165772 A1 7/2009 Hunt et al.
2009/0173238 A1 7/2009 Martinez et al.
2009/0229476 A1 9/2009 Bedard
2009/0293860 A1 12/2009 Carlson
2009/0301463 A1 12/2009 Park
2010/0051600 A1 3/2010 Maier
2010/0084355 A1 4/2010 Parks et al.
2010/0124596 A1 5/2010 Nelson
2010/0147281 A1 6/2010 Gustavsen
2010/0218754 A1 9/2010 Kuntz
2010/0258104 A1 10/2010 DeFoort et al.
2011/0048399 A1 3/2011 Hong
2011/0123689 A1 5/2011 Luckhardt et al.
2011/0132347 A1 6/2011 Kim
2011/0197872 A1 8/2011 Thiry
2011/0214662 A1 9/2011 Contarino, Jr.
2011/0219957 A1 9/2011 Fogolin
2011/0219958 A1 9/2011 Noble
2011/0265663 A1 11/2011 Li
2012/0017884 A1 1/2012 Van Den Hoff et al.
2012/0060819 A1 3/2012 Hunt et al.
2012/0076351 A1 3/2012 Yoon et al.
2012/0107476 A1 5/2012 McLemore et al.
2012/0174798 A1 7/2012 Kulikowski
2012/0225178 A1 9/2012 Degnan
2012/0240790 A1 9/2012 Difante
2012/0258229 A1 10/2012 Mindrup
2012/0260903 A1 10/2012 Buerkle
2012/0269028 A1 10/2012 Gordon
2013/0074702 A1 3/2013 Difante
2013/0081609 A1 4/2013 Dhuper et al.

(56) References Cited

U.S. PATENT DOCUMENTS

| | | | |
|---|---|---|---|
| 2013/0112186 | A1 | 5/2013 | Crichlow |
| 2013/0125765 | A1 | 5/2013 | Difante |
| 2013/0276643 | A1 | 10/2013 | Krolick et al. |
| 2013/0319258 | A1 | 12/2013 | Cleveland et al. |
| 2014/0026762 | A1 | 1/2014 | Riefenstein |
| 2014/0026881 | A1 | 1/2014 | Abrams et al. |
| 2014/0048055 | A1 | 2/2014 | Ruther |
| 2014/0130788 | A1 | 5/2014 | Contarino, Jr. |
| 2014/0144333 | A1 | 5/2014 | Ahmed |
| 2014/0165851 | A1 | 6/2014 | Shingler |
| 2014/0196609 | A1 | 7/2014 | Snyman |
| 2014/0251160 | A1 | 9/2014 | Contarino, Jr. |
| 2014/0287119 | A1 | 9/2014 | Dahle et al. |
| 2014/0299005 | A1 | 10/2014 | Vinett |
| 2015/0027432 | A1 | 1/2015 | Contarino, Jr. |
| 2015/0034065 | A1 | 2/2015 | McQuillan |
| 2015/0068512 | A1 | 3/2015 | Mehler et al. |
| 2015/0079250 | A1 | 3/2015 | Ahmed |
| 2015/0114238 | A1 | 4/2015 | Palermo |
| 2015/0124849 | A1 | 5/2015 | Parthasarathy |
| 2015/0164278 | A1 | 6/2015 | Kohler et al. |
| 2015/0201805 | A1 | 7/2015 | Cedar et al. |
| 2015/0208669 | A1 | 7/2015 | Klock et al. |
| 2015/0233585 | A1 | 8/2015 | Creel |
| 2015/0253364 | A1 | 9/2015 | Hieda et al. |
| 2015/0285512 | A1 | 10/2015 | Matarazzi et al. |
| 2015/0285513 | A1 | 10/2015 | Matarazzi et al. |
| 2015/0289719 | A1 | 10/2015 | Contarino, Jr. |
| 2015/0297029 | A1 | 10/2015 | Smith et al. |
| 2015/0305560 | A1 | 10/2015 | Hamlin |
| 2015/0320259 | A1 | 11/2015 | Tucker |
| 2015/0338104 | A1 | 11/2015 | Lipinski |
| 2015/0371513 | A1 | 12/2015 | Stokes |
| 2016/0102868 | A1 | 4/2016 | Johnson et al. |
| 2016/0102869 | A1 | 4/2016 | Johnson et al. |
| 2016/0174766 | A1 | 6/2016 | Schlosser et al. |
| 2016/0183723 | A1 | 6/2016 | Nadal |
| 2016/0183724 | A1 | 6/2016 | Nadal |
| 2016/0227965 | A1 | 8/2016 | Johnston et al. |
| 2016/0302606 | A1 | 10/2016 | Kallos |
| 2016/0334112 | A1 | 11/2016 | Wiseman et al. |
| 2016/0366314 | A1 | 12/2016 | Pfaffinger, Jr. et al. |
| 2017/0020148 | A1 | 1/2017 | Dixon et al. |
| 2017/0020337 | A1 | 1/2017 | Borovicka et al. |
| 2017/0055535 | A1 | 3/2017 | Froelicher et al. |
| 2017/0065124 | A1 | 3/2017 | Colston |
| 2017/0074522 | A1 | 3/2017 | Cheng |
| 2017/0102149 | A1 | 4/2017 | Nadal |
| 2017/0115008 | A1 | 4/2017 | Erbe et al. |
| 2017/0195542 | A1 | 7/2017 | Thomas et al. |
| 2017/0257226 | A1 | 9/2017 | Bi |
| 2017/0261213 | A1 | 9/2017 | Park et al. |
| 2017/0303348 | A1 | 10/2017 | Kondo et al. |
| 2017/0332841 | A1 | 11/2017 | Reischmann |
| 2018/0058702 | A1 | 3/2018 | Jang et al. |
| 2018/0157232 | A1 | 6/2018 | Chen |
| 2018/0187898 | A1 | 7/2018 | Matarazzi et al. |
| 2018/0296031 | A1 | 10/2018 | Terrell, Jr. et al. |
| 2018/0324908 | A1 | 11/2018 | Denker et al. |
| 2018/0325314 | A1 | 11/2018 | Walters |
| 2018/0347821 | A1 | 12/2018 | Wild |
| 2018/0368618 | A1 | 12/2018 | Measom et al. |
| 2018/0372326 | A1 | 12/2018 | Park et al. |
| 2019/0132396 | A1 | 5/2019 | Finnegan et al. |
| 2019/0134580 | A1 | 5/2019 | Ghazarian |
| 2019/0274476 | A1 | 9/2019 | Dahle et al. |
| 2019/0277509 | A1 | 9/2019 | Hildner et al. |
| 2019/0285283 | A1 | 9/2019 | Ebrom et al. |
| 2019/0298107 | A1 | 10/2019 | Baker et al. |
| 2020/0041134 | A1 | 2/2020 | Luckhardt et al. |
| 2020/0069111 | A1 | 3/2020 | Eiter et al. |
| 2020/0154943 | A1 | 5/2020 | Baker |
| 2020/0154944 | A1 | 5/2020 | Baker |
| 2020/0214503 | A1 | 7/2020 | Altenritter |
| 2020/0236743 | A1 | 7/2020 | Yang et al. |
| 2020/0281402 | A1 | 9/2020 | Witzel et al. |
| 2021/0052107 | A1 | 2/2021 | Pruitt et al. |
| 2021/0071871 | A1 | 3/2021 | Stork-Wersborg |
| 2021/0113016 | A1 | 4/2021 | Dean |
| 2021/0152578 | A1 | 5/2021 | Alanazi |
| 2021/0222887 | A1 | 7/2021 | Moore et al. |
| 2021/0356130 | A1 | 11/2021 | Li |
| 2021/0401223 | A1 | 12/2021 | Han et al. |
| 2022/0170638 | A1* | 6/2022 | Baker ..... F24B 5/087 |
| 2022/0373173 | A1 | 11/2022 | Chlebovec |
| 2023/0083403 | A1 | 3/2023 | Jun et al. |

FOREIGN PATENT DOCUMENTS

| | | | | |
|---|---|---|---|---|
| CN | 102300492 | | | 12/2011 |
| CN | 206669789 | U | | 11/2017 |
| CN | 107616719 | | | 1/2018 |
| CN | 107697574 | | | 2/2018 |
| CN | 107697574 | A | * | 2/2018 |
| CN | 208967878 | U | | 6/2019 |
| CN | 211657980 | U | | 10/2020 |
| CN | 112263156 | | | 1/2021 |
| CN | 112716318 | | | 4/2021 |
| CN | 213189188 | U | | 5/2021 |
| CN | 113558489 | | | 10/2021 |
| CN | 114089639 | | | 2/2022 |
| DE | 102008042804 | | | 4/2009 |
| DE | 202013000669 | U1 | | 6/2013 |
| FR | 2597319 | | | 10/1987 |
| JP | 2008286466 | | | 11/2008 |
| KR | 20160069359 | | | 6/2016 |
| WO | 2022/204182 | | | 9/2022 |

OTHER PUBLICATIONS

International Preliminary Report on Patentability dated May 17, 2022, in International Patent Application No. PCT/US2020/062211, 9 pages.

International Search Report and Written Opinion of the International Searching Authority completed Jan. 22, 2021, in International Patent Application No. PCT/US2020/062211, 10 pages.

International Search Report and Written Opinion of the International Searching Authority completed Feb. 15, 2024, in International Patent Application No. PCT/US2023/080610, 19 pages.

International Search Report and Written Opinion of the International Searching Authority completed Oct. 20, 2022 (+ English translation), in International Patent Application No. PCT/CN2022/078958, 15 pages.

Casement Window: Site Visited Oct. 30, 2024, available from URL: https://www.archiexpo.com/prod/andersen/product-8990-1349389.html, 3 pages.

Drip EZ Pellet Grip Hopper Shelf, announced online Jun. 23, 2023, site visited Oct. 30, 2024, at https://www.bbqguys.com/drip-ez/pellet-grill-hopper-shelf-hs-1, 7 pages.

GMG Hopper Assembly for Ledge, site visited Oct. 30, 2024, available from URL: https://grillcollection.com/products/gmg-hopper-assembly-for-ledge-daniel-boone-and-peak-jim-bowie-12v-only-stainless-steel-lid-with-window, 6 pages.

* cited by examiner

VARIABLE FUEL COOKER

RELATED APPLICATION

This application claims the benefit of priority from U.S. Provisional Patent Application No. 63/640,706 filed Apr. 30, 2024, the contents of which are incorporated herein by reference.

FIELD OF THE INVENTION

The present invention relates to systems and devices for delivering combustible material to a burn box for use in cooking appliances such as grills, smokers, or other types of cookers.

BACKGROUND OF THE INVENTION

Grills and smokers have long been popular tools for outdoor cooking, with wood pellets often used as fuel due to their ability to provide consistent heat and flavor. However, wood pellets are expensive to produce, requiring a significant amount of energy. The process involves grinding wood into fine sawdust, pushing it through a die under high temperature and pressure to melt the lignin, and then rapidly cooling the material to form pellets. This energy-intensive process may reduce the wood's natural flavor imparted by guaiacol—a key molecule responsible for the distinct taste of smoked foods.

Wood chips, by contrast, require only minimal processing—typically just one or two passes through a chipper—without the need for high energy consumption or complex machinery. As a result, wood chips offer a good alternative to pellets. Furthermore, it is believed that wood chips, due to the preservation of guaiacol during the chipping process, may impart a richer, more authentic wood smoke flavor to food compared to pellets.

In addition to requiring minimal processing, wood chips offer functional advantages in grilling, such as retaining higher moisture content than pellets. Wood chips used in the grills typically contain 15-20% moisture, compared to the 8-10% moisture found in wood pellets. This higher moisture content enhances the grilling process, helping to keep food moister and more tender by releasing steam as the wood burns. The result is juicier, more flavorful grilled meats, such as rotisserie chicken, that benefit from the increased moisture released during cooking.

Despite the advantages of wood chips, their use in grills and smokers has been limited due to challenges in reliably delivering them to the firebox. Wood chips, being irregular in shape and size, are prone to jamming, which can interrupt the flow of fuel and cause inconsistent cooking temperatures. The present invention addresses these issues by providing a reliable system for delivering wood chips or other irregular combustible material to a firebox, particularly in a barbecue grill setting, as well as to reduce backflow of combustion gases.

Moreover, due to different structural and functional demands related to burning the different types of fuel, it has not been possible or practical to provide for grills or smokers configured to effectively use both wood pellets and wood chips. The present invention addresses these issues and provides increased versatility by allowing users to switch between wood pellets and wood chips, depending on fuel preference or availability. Unlike traditional pellet grills that are limited to pellet fuel, this dual fuel capability ensures greater convenience and flexibility. Users can choose pellets when a milder smoke flavor or choose wood chips when seeking a more robust smoke flavor, or otherwise dependent on fuel availability. This adaptability provides significant practical benefits, especially in situations when specific cooking outcomes are desired, such as baking, or where one fuel type may be unavailable.

SUMMARY OF THE INVENTION

The present invention is directed to an auger-based material transport system designed to prevent jamming, ensure consistent material flow, and reduce backflow of combustion gases, while enabling the use of irregularly shaped and sized combustible materials. The invention also addresses mechanisms for controlling the flow of combustible material, reducing the risk of bridging, and enhancing overall system reliability and efficiency. The invention also incorporates an automated switching and programming system that adjusts operational parameters such as auger speed, fan speed, and hopper agitation based on the type of combustible material being used, further optimizing fuel delivery, combustion efficiency, and temperature control.

The invention features an auger tube larger in diameter than the auger itself, allowing the auger to pivot when it encounters larger chips, thus preventing jams. This design has proven effective in maintaining a consistent flow of wood chips, something that was not possible with previous designs that used fixed-position augers. Additionally, the inclusion of a rotating clearing mechanism ensures that the wood chips do not bridge or clump together, further improving the reliability of the fuel delivery system. In addition, the inclusion of an optional auger cover flap reduces backflow of combustion gases. Additionally, in some embodiments the present invention incorporates an advanced switching and programming system that adjusts the auger speed and fuel feed rate based on the type of fuel selected, ensuring consistent combustion performance and preventing jams. This innovation makes the use of wood chips in grills and smokers more practical and safer, and that represents a significant advancement in barbecue technology.

In certain embodiments, a device for delivering and burning combustible material includes a hopper, a burn box to receive and burn the combustible material, an auger tube through which the combustible material is moved from the hopper to the burn box, a motor, and an auger pivotably connected within the auger tube to facilitate adjustment of the auger's orientation within the auger tube in response to irregularly sized or shaped combustible material. In alternative embodiments, the motor includes a drive shaft having an axis of rotation and the auger is pivotably connected to the drive shaft to allow the auger to pivot relative to the drive shaft about an axis substantially perpendicular to the axis of rotation of the drive shaft.

In other embodiments, an apparatus for delivering and burning combustible material includes a hopper to store combustible material, a burn box having an inner volume defined by a sidewall and a bottom wall capable of burning combustible material, an auger tube having an inlet end in communication with the hopper and an outlet end in communication with the burn box, the auger tube suitable for transporting combustible material from the hopper to the burn box, a motor configured to drive the auger, the motor having a drive shaft with an axis of rotation, and an auger positioned within the auger tube, the auger being rotatable about a longitudinal axis to facilitate movement of the combustible material through the auger tube, wherein the auger is pivotably connected within the auger tube to facilitate adjustment of the auger's orientation within the auger tube in response to irregularly sized or shaped combustible material. In alternative embodiments, the auger pivots relative to the drive shaft about an axis that is substantially perpendicular to the axis of rotation of the drive shaft.

In certain other embodiments, a system for delivering and burning combustible material in a cooking appliance including a hopper to store combustible material, an auger tube having an inlet end in communication with the hopper and an outlet end, the auger tube facilitating transport of combustible material from the hopper to the outlet end, an auger positioned within the auger tube, the auger being rotatable about a longitudinal axis to move the combustible material through the auger tube, a burn box having an inner volume defined by a sidewall and a bottom wall, the burn box receives and burns combustible material delivered from the auger tube, a motor with a drive shaft having an axis of rotation, and a pivotable coupling connecting the auger to the drive shaft of the motor, the pivotable coupling enabling the auger to pivot relative to the drive shaft about an axis that is substantially perpendicular to the axis of rotation of the drive shaft, wherein the auger can pivot within the auger tube in response to irregularly sized or shaped combustible material.

In alternative embodiments, the invention includes a cover flap pivotally mounted at an outlet end of the auger tube to cover the outlet end to allow combustible material to exit the outlet end when the auger is rotating with combustible material in the auger tube without allowing combustible material in the auger tube to ignite. In certain embodiments, the invention includes a loop extending through at least two openings in the cover flap, the loop being attached to the auger tube or the burn box, wherein the cover flap is constrained to pivot around the loop in a path that is substantially parallel to the longitudinal direction of the auger tube. In other embodiments, the cover flap lays flat against the outlet end under the force of gravity when the auger is not rotating, thereby preventing combustion gases from escaping into the auger tube, and pivots open when the combustible material is forced through the auger tube by the rotating auger.

In alternative embodiments, the diameter of the auger tube is substantially larger than the diameter of the auger.

In alternative embodiments, at least one pin is rotatably mounted over an opening through which combustible material engages the auger and is oriented substantially perpendicular to the axis of rotation of the auger.

In certain embodiments, the grill incorporates a switching control system that, upon selection, adjusts its internal programming when transitioning between different fuel types. This system modifies both structural and functional parameters, including the speed of the auger, the speed of the fan, and the activation of an agitator, to ensure the optimal fuel feed rate for maintaining the desired British Thermal Unit (BTU) output. The programming is designed to accommodate the differences in burn characteristics between wood chips and pellets, adapting the operation of the grill to match the fuel's specific energy content and combustion behavior. This level of adjustment provides a seamless cooking experience, making the Present invention highly adaptable for various grilling scenarios.

In other embodiments, the invention's switching and programming system operates through an integrated control board that detects the type of fuel being used—whether wood chips or pellets—and adjusts the grill's operational parameters accordingly. Upon switching fuel types, the control system automatically reconfigures key components, such as the auger speed, burn box air intake, and hopper agitation, to maintain optimal combustion and achieve the required heat output or BTU. This programming dynamically recalibrates the system based on real-time fuel demands and energy output, ensuring that the grill provides efficient and consistent performance regardless of the fuel type. By automating these adjustments, the system eliminates the need for manual intervention, allowing the user to seamlessly transition between fuel sources while maintaining precise temperature control and fuel efficiency, effectively enhancing the grill's versatility and usability.

BRIEF DESCRIPTION OF THE DRAWINGS

Preferred and alternative examples of the present invention are described in detail below with reference to the following drawings.

DETAILED DESCRIPTION OF THE PREFERRED EMBODIMENT

Figure 1:
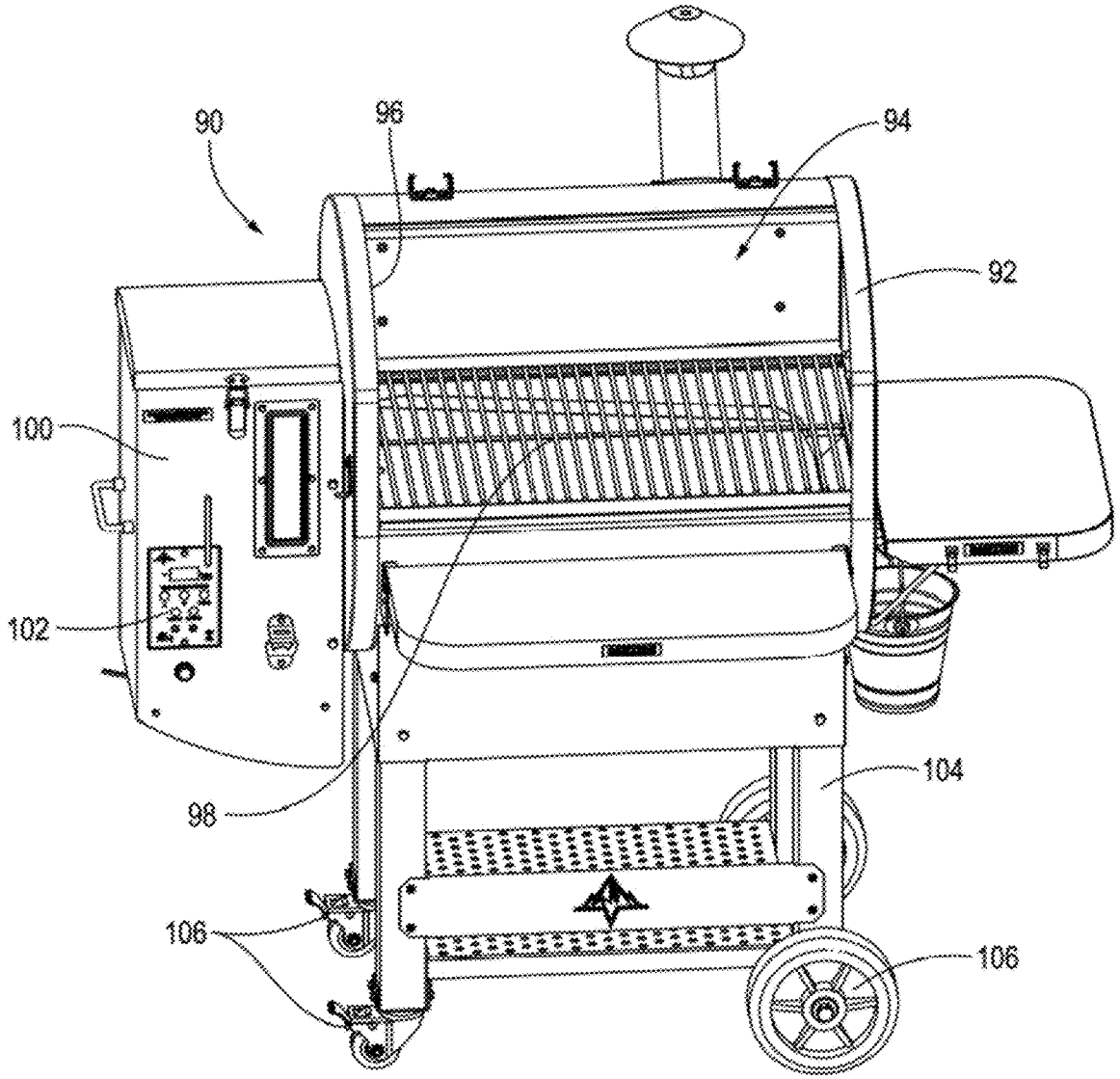
FIG. 1 is an external view of a cooker, such as a grill or smoker, incorporating an auger cover flap system and integrated programmable controller illustrating the placement of a burn box, auger system, and programmable controller within a cooker housing.

Referring to FIGS. 1 through 4, a cooker 90, such as a smoker, outdoor grill, or other type of cooker includes a housing 92 defining a cooking chamber 94. The cooking chamber 94 may be accessible through an opening 96 that is selectively covered by a lid (not shown). A grill 98 or other support surface may be positioned within the cooking chamber 94 for supporting an item cooked within the cooking chamber 94. A control housing 100 mounted to or near the housing 92 may contain a hopper 78, fan 70, motor 72, an air chamber 74, an auger tube 14, an auger 16, and a motor 80 for driving the auger 16. The control housing 100 may further house a programmable controller 102 coupled to the motors 72, 80 and configured to control the motors 72, 80, such as in response to the output of a sensor configured to sense the temperature within the cooking chamber 94 and coupled to the programmable controller 102. The programmable controller 102 can be configured for the type of combustible material being used (wood chips or pellets) and automatically adjust hopper agitation, auger speed, and fan operation to optimize cooking performance based on the selected or detected fuel type, ensuring consistent heat output and efficient fuel consumption. The housing 92 and/or control housing 100 may be mounted to a frame 104 that itself is mounted on wheels 106 for relocating the cooker 90. The auger tube 14 and auger 16 extend into the cooking chamber 94 with a burn box 24 (see FIG. 6) located in and/or under the cooking chamber 94.

In a preferred embodiment, the hopper 78 incorporates a trap door element at the base of the hopper 78 (not shown) to aid in efficiently removing combustible material if the user elects to switch from the type contained in the hopper 78. One of ordinary skill in the art would recognize a trap door element could have various dimensions and be placed in multiple locations around the hopper 78 such that the force of gravity would cause the combustible material to fall through the trap door and out of the hopper 78.

The illustrated cooker 90 is exemplary only. Any cooker or heating device using an auger to supply combustible material to be burned may benefit from the invention features described herein.

Figure 2:
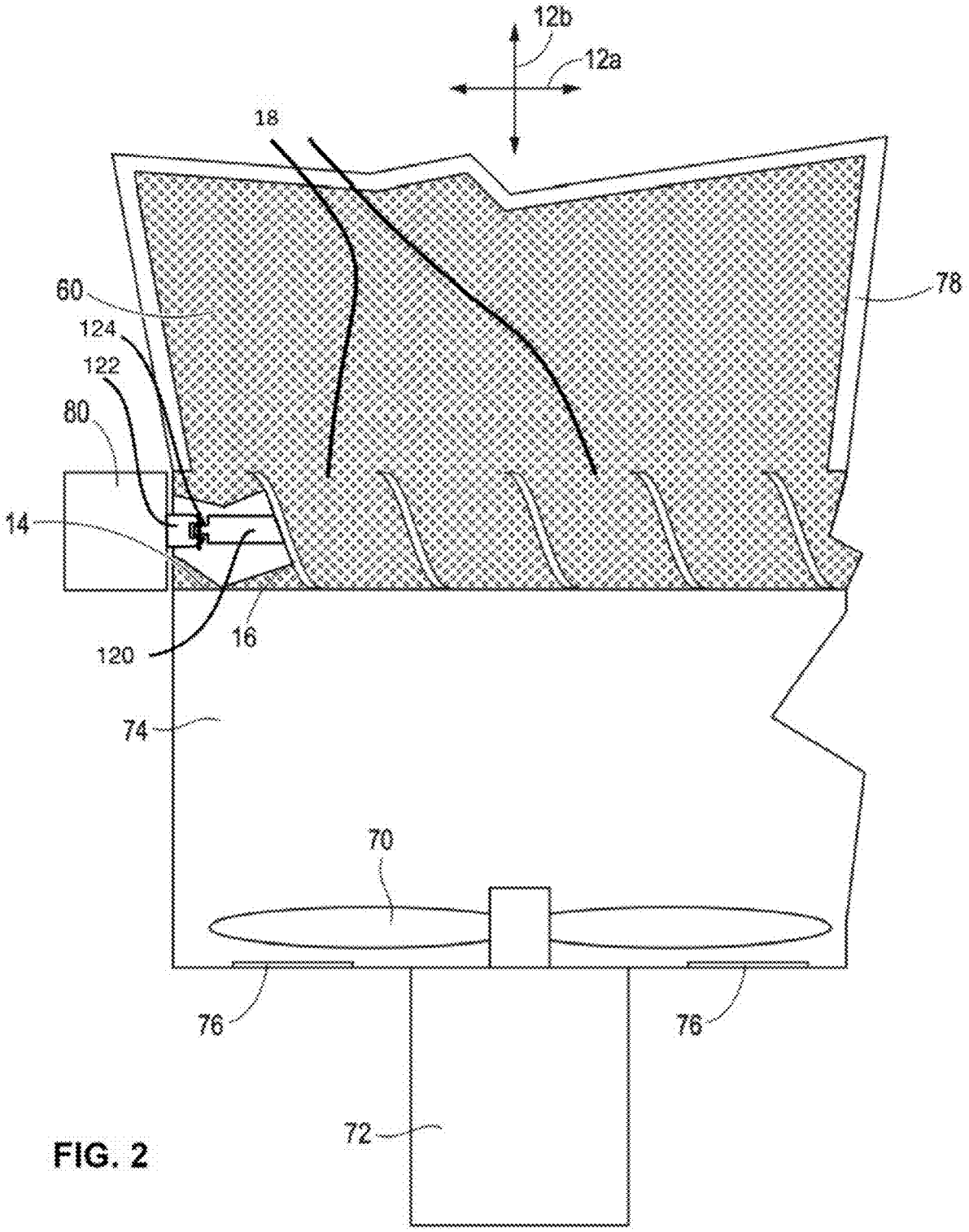
FIG. 2 is a cross-sectional view of a part of the cooker housing including a hopper, an auger tube, the burn box, a programmable controlled fan, and a programmable controlled motor assembly showing the overall arrangement of components, and further showing an embodiment including a pivotable coupling between an auger shaft and a drive motor that allows an auger to pivot within the auger tube to accommodate irregularly shaped combustible materials.
Figure 3:
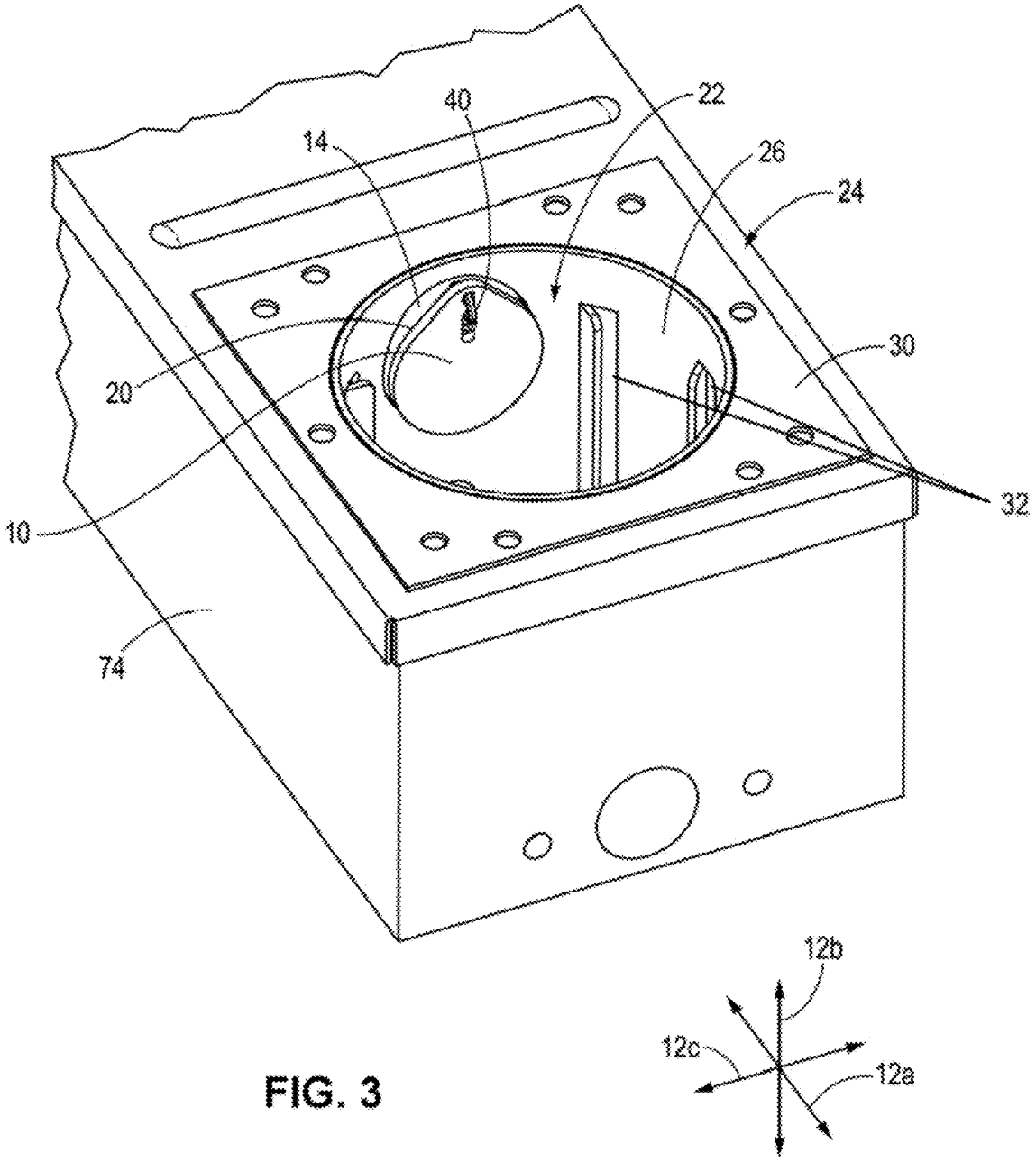
FIG. 3 is a perspective view of the burn box showing the overall arrangement of components around an auger cover flap.

Referring to FIGS. 2 and 3, the auger 16 may be formed in a spiral shape around an auger shaft 120, such as shaft made of steel, aluminum, or other material. The auger shaft 120 is coupled to the motor 80 such that the auger shaft 120 can pivot relative to the motor 80 about an axis that is substantially (e.g., within 10, 5, or 2 degrees of) perpendicular to the axis of rotation of a motor shaft 122 from the motor 80. For example, the auger shaft 120 may be coupled to the motor shaft 122 by a pin 124. Alternatively, the joint between the auger shaft 120 and the motor shaft 122 may be embodied as a clevis pin link, universal joint, or other type of joint permitting rotation about a first axis while enabling torque transmission about a second axis that is substantially perpendicular to the first axis. In yet another alternative embodiment, a spring wound in the same direction as the rotation of the auger, concentrically connected between the auger and the motor, allows the auger to "float" within the confines of the auger tube in any points in the plane defined by a cross-section of the auger tube.

The hopper 78 containing the combustible material 60 that may be positioned above the auger 16 and auger tube 14. The auger 16 is rotated by the motor 80, causing the combustible material 60 to be conducted along the auger tube 14 to the inner volume 22 of the burn box 24. The auger 16 is rotated by a motor or manually to drive combustible material from an opening 18 positioned under the hopper 78 or other source of the combustible material to an outlet end 20. As is apparent, the outlet end 20 may be substantially (e.g., within 5 degrees of) perpendicular to the axis of symmetry of the cylindrical auger tube 14. The axis of symmetry of the cylindrical auger tube 14 may be substantially (e.g., within 5 degrees of) parallel to the longitudinal direction 12*a* such that the outlet end 20 is substantially parallel to the vertical direction 12*b* and horizontal direction 12*c*. Likewise, the axis of rotation of the auger 16 may be substantially parallel to the longitudinal direction 12*a*.

The outlet end 20 is positioned within, or is otherwise in fluid communication with an inner volume 22 of the burn box 24 in which combustible material is burned to heat a cooking chamber, grill, or other structure. In the illustrated embodiment, the inner volume of the burn box 24 is defined by a sidewall 26 having and a bottom wall 28 extending across the bottom of the sidewall 26. The upper end of the sidewall 26 may be open and may have a mounting plate 30 mounted thereto for mounting the burn box 24 to cooking chamber, housing for a grill, or other structure. In the illustrated embodiment, the sidewall 26 is generally cylindrical with various openings formed therein, with the axis of the cylinder being substantially parallel to the vertical direction 12*b*. The sidewall 26 may have one or more vent openings 32 formed therein. In the illustrated embodiment, louvers 34 positioned adjacent each opening 32 direct air passing through the openings 32 into the inner volume 22 to spin, thereby cooling the sidewall 26. The louvers 34 may be formed by bending portions of the sidewall 26 inward. The outlet end 20 may be positioned closer to the top of the sidewall 26 than to the bottom wall 28 such that combustible material forced out of the outlet end 20 by the auger 16 will fall onto the bottom wall 28 and be burned. The burn box 24 may be configured according to any approach for implementing a burn box known in the art. The burn box 24 may include an igniter, temperature sensor, fuel sensor, or any other component known to be used with a burn box 24.

Figure 4:
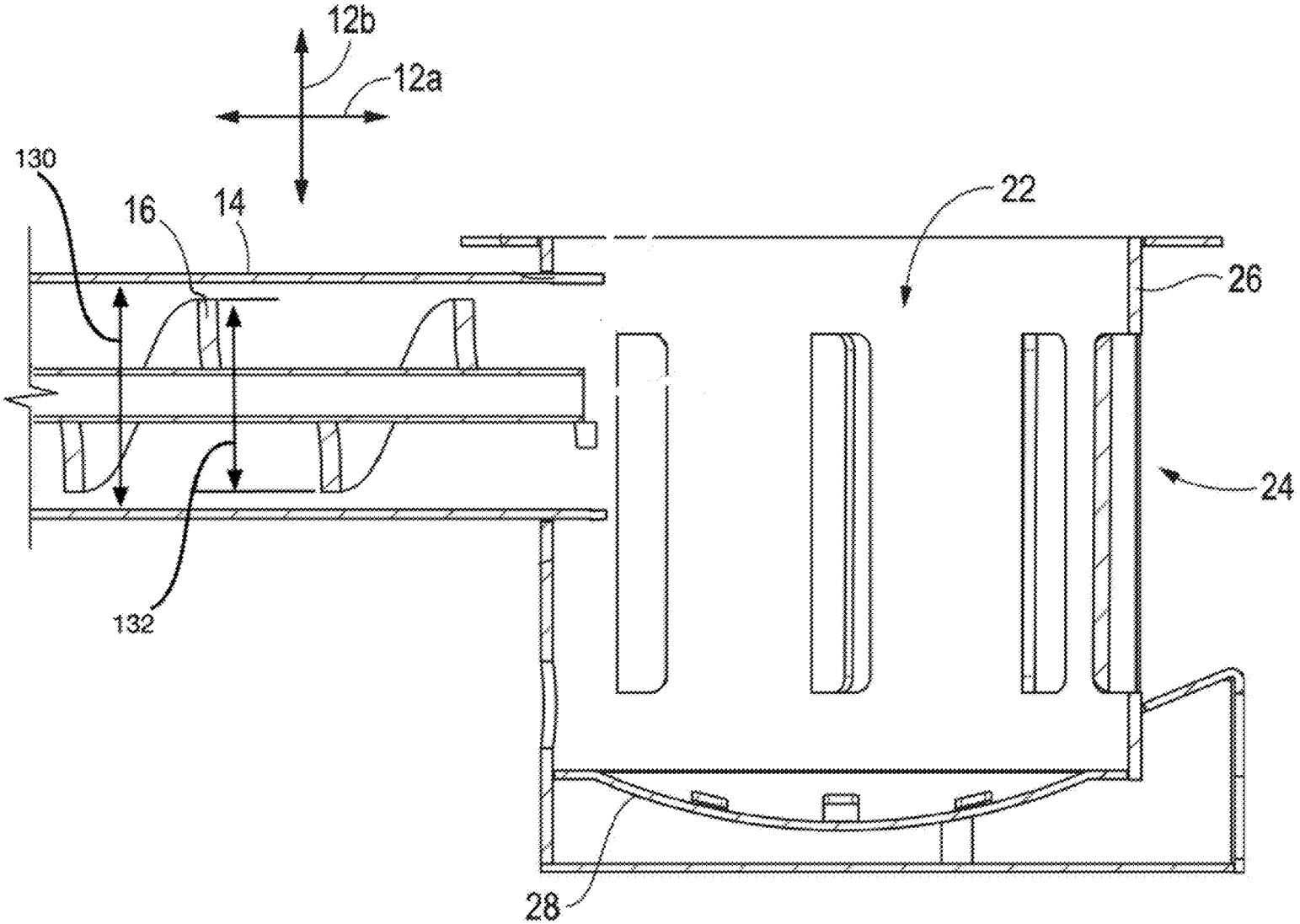
FIG. 4 is a cross-sectional view of the oversized auger tube relative to the auger, highlighting the space that allows the auger to dynamically "float" and prevent jamming when larger chunks of combustible material are used.
Figure 5:
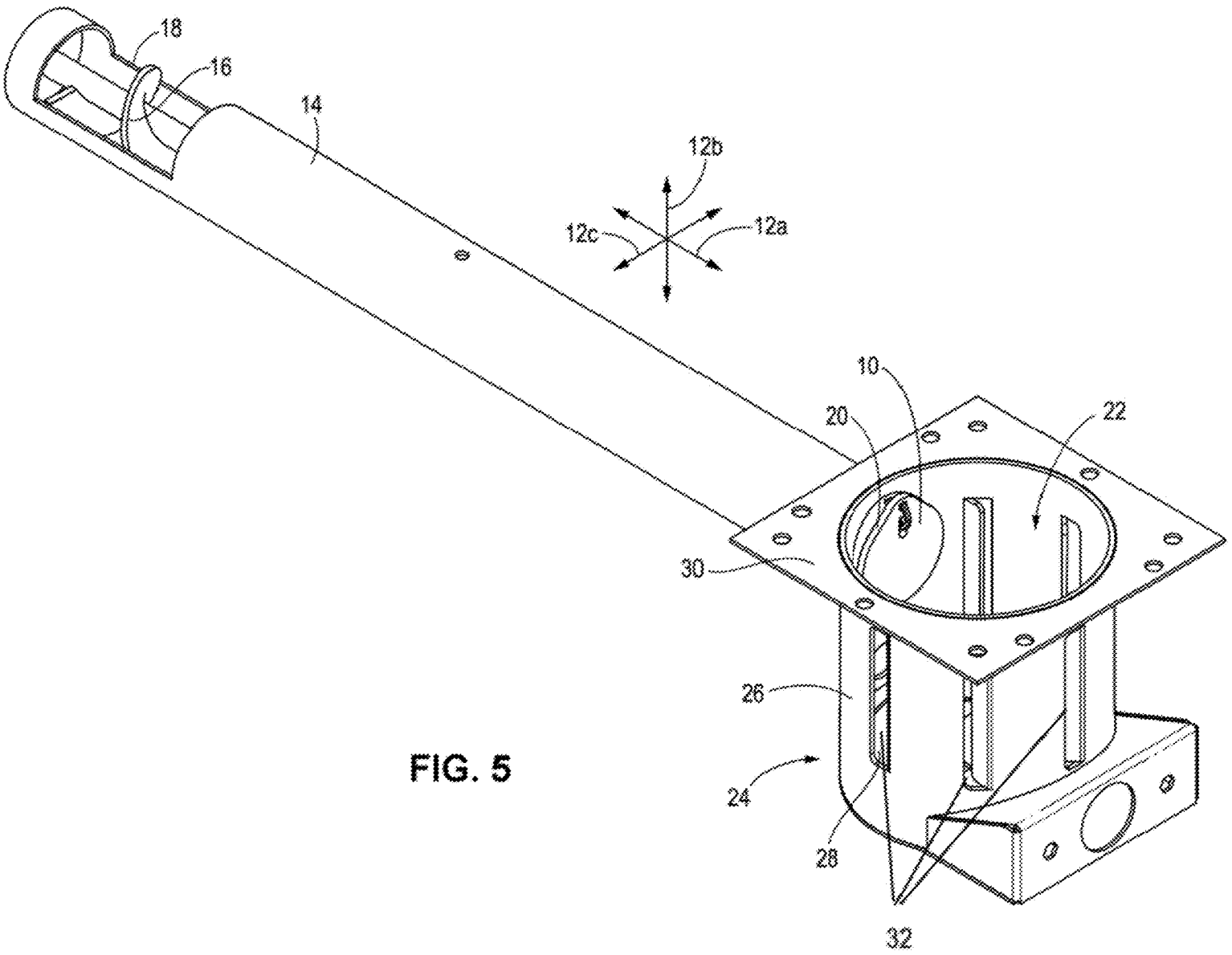
FIG. 5 is a perspective view of the auger cover flap and associated components within the auger tube and burn box assembly illustrating the orientation of the auger cover flap with respect to the longitudinal, vertical, and horizontal directions.

Referring to FIG. 4, in some embodiments, a diameter 130 of the auger tube 14 may be substantially larger than a diameter 132 of the auger 16, such as between 5 and 25 percent larger, or between 10 and 15 percent larger. In some embodiments, diameter 130 is at least. 375 inches larger than the diameter 132. The difference in diameters 130, 132 in combination with the joint between the motor and auger shafts 120, 122 enables the auger 16 to "float." When using irregularly sized and shaped combustible material 60 (shown with reference to FIG. 9), there may be chunks or clumps of combustible material 60 that would tend to jam the auger 14. Enabling the auger 16 to pivot within an oversized tube 14 reduces the probability of this occurring. Enabling the auger 16 to pivot further enables the combustible material 60 to include larger chunks, which are cheaper to make. Enabling the auger 16 to pivot further reduces the amount of power required from the motor 80 in order to achieve consistent operation.

In some embodiments, a fuel conditioner may be positioned between the hopper 78 and the auger tube 14 for grinding wood chips into smaller wood chips or otherwise modifying one or more of the size, shape, or uniformity of the fuel, as described in U.S. Pat. No. 11,940,153, commonly assigned, entitled FUEL CONDITIONER FOR GRILL, which is hereby incorporated herein by reference in its entirety.

A person of skill in the art would understand from the present disclosure that other intermediate elements can be included between the hopper 78 and the burn box 24. For example, the present invention may use an auger 18 or another form of channel fluidly coupled to the outlet of hopper 78 and the burn box 24. A channel, such as an auger tube 14, can have a diameter of, for example, 2.2 inches, 2-2.5 inches, 1.5-3 inches, or any other diameter sized to pass wood chips, which may or may not be pre-conditioned. Whether or not conditioned via an integrated fuel conditioner or pre-conditioned, wood chips 60 exiting the hopper 78 or fuel conditioner can travel through the channel to the burn box 24 for use as fuel. The channel could have a smooth inner surface to facilitate passage of wood chips 60 to the burn box 24 by pressure from the hopper 78 or fuel conditioner. A person of ordinary skill in the art would understand from the present disclosure that channel can be sized to ensure that maximum and/or average sized wood chips 60 can pass through at a rate sufficient to maintain typical and/or maximum desired cooking temperatures within the cooking chamber. And could be equipped with an auger 16 to facilitate or regulate the flow of wood chips 60 through the auger tube 14 to the burn box 24.

In some embodiments, the present invention may incorporate a programmable controlled clearing mechanism or agitator an agitator 138, described below with reference to FIG. 9, or other source of vibration to facilitate the flow of wood chips 60 from the hopper 78 to the burn box 24.

In some embodiments, described with reference to FIGS. 3 and 5-8, an auger cover flap 10 may be used to reduce combustion of pellets, wood chips, or other combustible material within the auger tube 14 having the auger 16 positioned therein. The auger flap 10 may be understood with respect to a longitudinal direction 12*a*, vertical direction 12*b*, and horizontal direction 12*c* that are all mutually perpendicular. The vertical direction 12*b* may correspond to the direction of gravity during use.

The auger flap 10 may be mounted to the auger tube 14, or to the sidewall 26 by a loop 40. The loop 40 may pass through an upper opening 42 defined by the auger flap 10 and a lower opening 44 defined by the auger flap 10. The openings 42, 44 may be offset from one another along the vertical direction 12*b*. The lower opening 44 may be oblong with the long dimension thereof oriented substantially (e.g., within 5 degrees of) parallel to the vertical direction 12*b*. For example, the long dimension of the lower opening 44 may be between 1.5 and 4 times the diameter of the upper opening 42, which may be substantially the same, e.g., within 5% of, the width of the lower opening 44 in the horizontal direction 12*c*. The diameter of the upper opening 42 and width of the lower opening 44 may be slightly, e.g., between 1 and 5 percent greater than the width of the loop 40 such that the openings 44 are able to freely slide along the loop 40.

In the illustrated embodiment, the auger flap 10 includes a circular portion 48. The circular portion 48 may be substantially, e.g., preferably within 3 percent of, equal to the outer diameter of the auger tube 14 and at least larger than the inner diameter of the auger tube 14 such that the auger flap 10 will not be inducted into the auger tube 14 during use. The auger flap 10 may include a non-circular portion 50, e.g., a protrusion from the circular portion 48. The upper opening 42 may be partially or completely positioned within the non-circular portion 50. In particular, the size of the loop 40 and position of the upper opening 42 may be such that at rest and under the action of gravity, the auger flap 10 will rest flat against the outlet end 20 with the perimeter of the circular portion 48 substantially aligned with the perimeter of the auger tube 14, e.g., within x*D of aligned along the vertical and horizontal directions 12*b*, 12*c*, where D is the diameter of the auger tube 14 and x is a value less than 0.1, 0.05, or 0.01. The auger flap 10 itself may be formed of a flat plate or other shape such that a surface of the auger flap 10 in contact with the outlet end 20 will conform to the outlet end 20. The auger flap 10 may be made of aluminum, stainless steel, or other type of steel or other metal.

The engagement of the openings 42, 44 with the loop 40 constrains the auger flap 10 to pivot around the loop 40, or cause the loop 40 to pivot within opening 46, in a rotational path 52 that is substantially, e.g., within 5 degrees of, parallel to the longitudinal direction 12*a* and the vertical direction 12*b*. The use of two openings 42, 44 rather than a single opening helps avoid movement of the auger flap away from the path 52 and becoming stuck in an open position.

The auger tube 14 may itself define an opening 46 with the loop 40 passing through the opening 46. The portion of the auger tube 14 defining the opening 46 may be positioned within the inner volume 22 of the burn box 24. The loop 40 may be implemented as a piece of metal formed into a ring. The loop 40 may for example be implemented as a curved or straight material bent into a ring shape passing through the openings 42, 44, 46. The loop 40 may be free to move within the opening 46 or may be welded or otherwise secured in place relative to the auger tube 14. The diameter of opening 46 may be slightly, e.g., between 1 and 5 percent greater than the width of the loop 40 such that the ring 40 is able to freely move through the opening 46.

Figure 6:
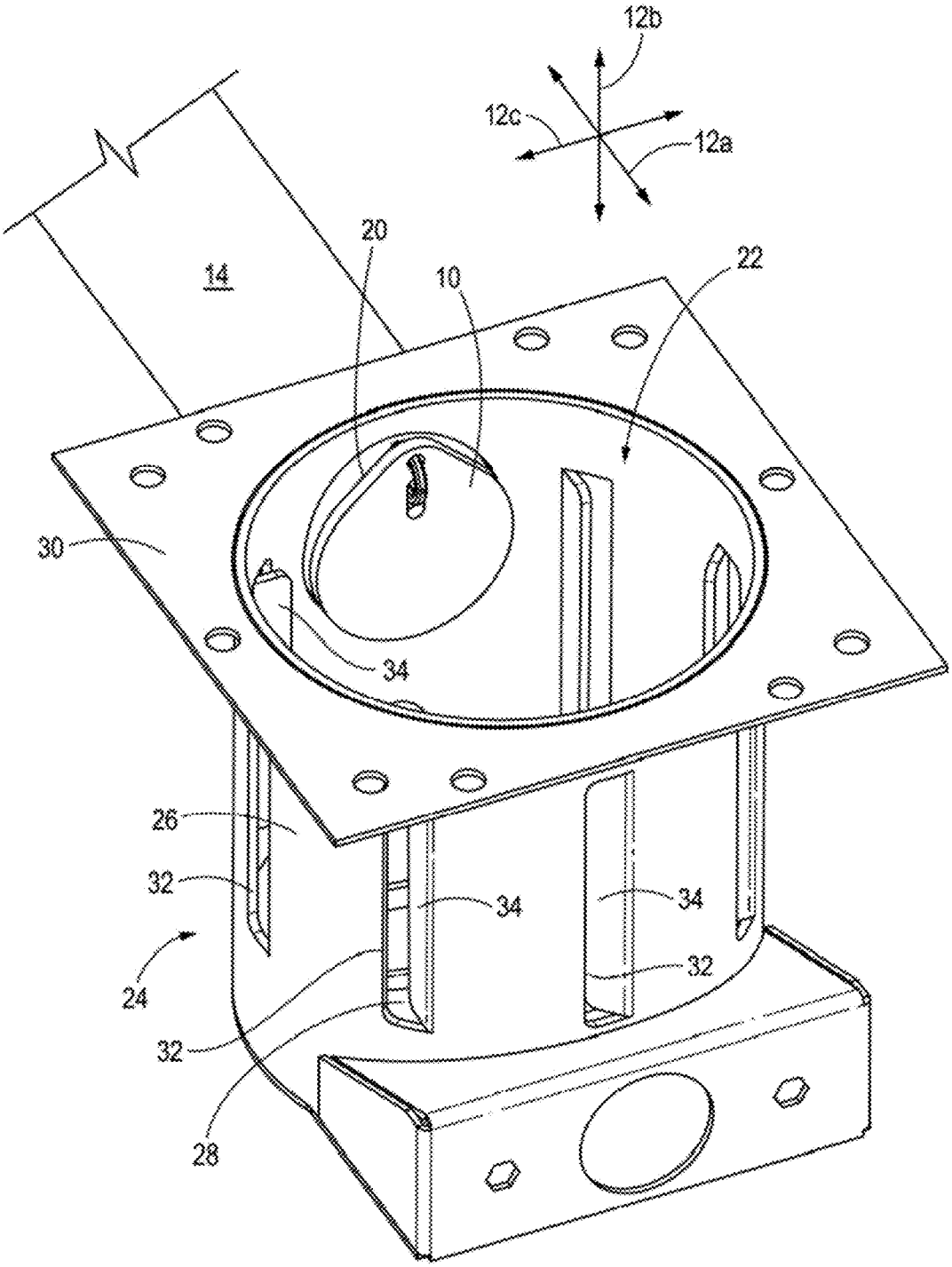
FIG. 6 is a side cross-sectional view of the auger tube, burn box, and auger cover flap assembly showing the internal components, including the positioning of the auger, burn box, and the relationship between the auger tube and the cover flap.
Figure 7:
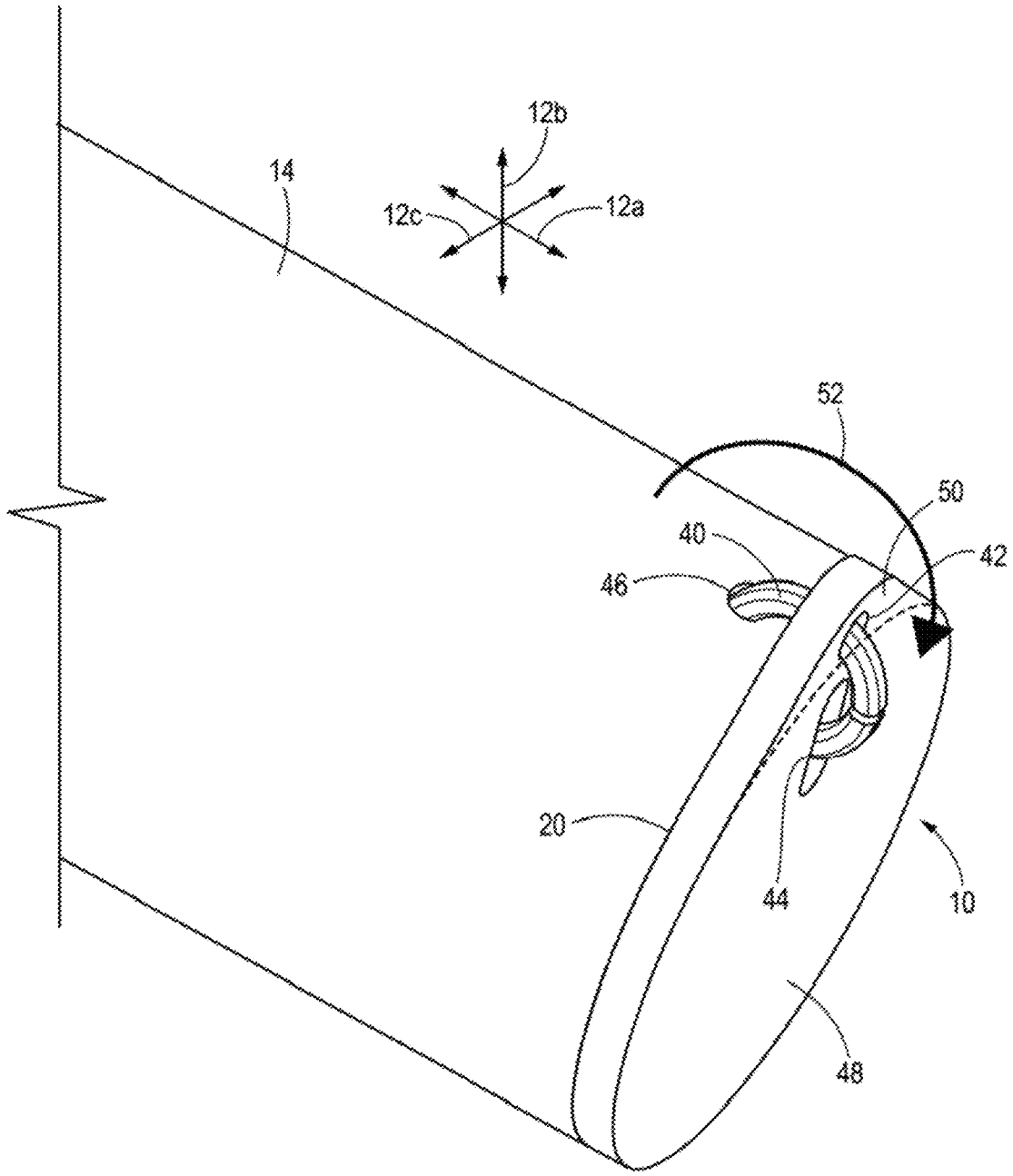
FIG. 7 is an exploded view of the auger flap, the auger tube, and a loop assembly depicting the attachment of the auger flap to the auger tube and the sidewall of the burn box via the loop, as well as a sliding mechanism of the auger flap along the loop assembly.

Referring back to FIGS. 2 and 3 and further with reference to FIG. 6, in some applications, air will be forced into the burn box 24 through openings 32. In such applications, the air pressure within the burn box 24 may urge the auger flap 10 against the outlet end 20 of the auger tube 14. For example, a fan 70 driven by a motor 72 may force air into an air chamber 74 through openings 76 for receiving ambient air. The air chamber 74 may be extended around the burn box 24 such that air forced into the air chamber 74 will be forced through the openings 32 into the inner volume 22, urging the openings 32 to spin via the louvres 34. In addition, the programmable controller 102 can adjust the fan speed in response to real-time temperature data or fuel type, optimizing airflow for more efficient combustion based on the material being used, whether wood chips or pellets, to ensure consistent cooking performance.

Figure 8A:
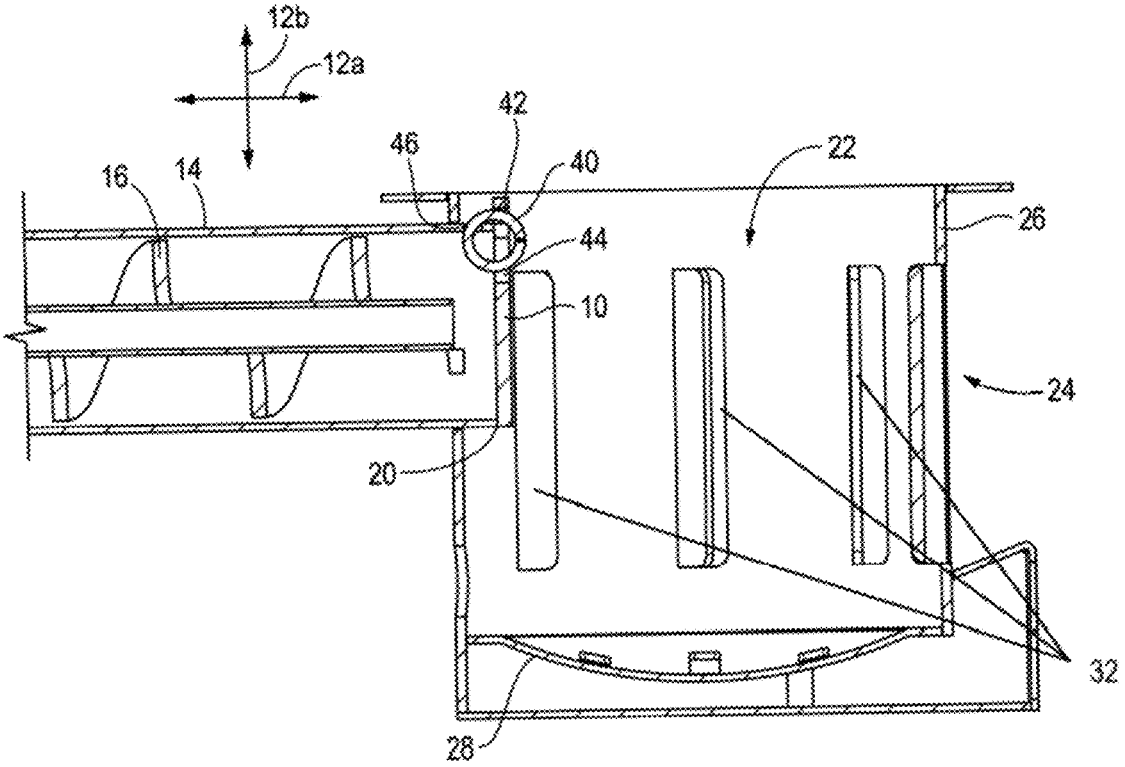
FIG. 8A is a cross-sectional view of the auger flap in a closed position against the outlet end of the auger tube when no combustible material is being pushed through by the auger.
Figure 8B:
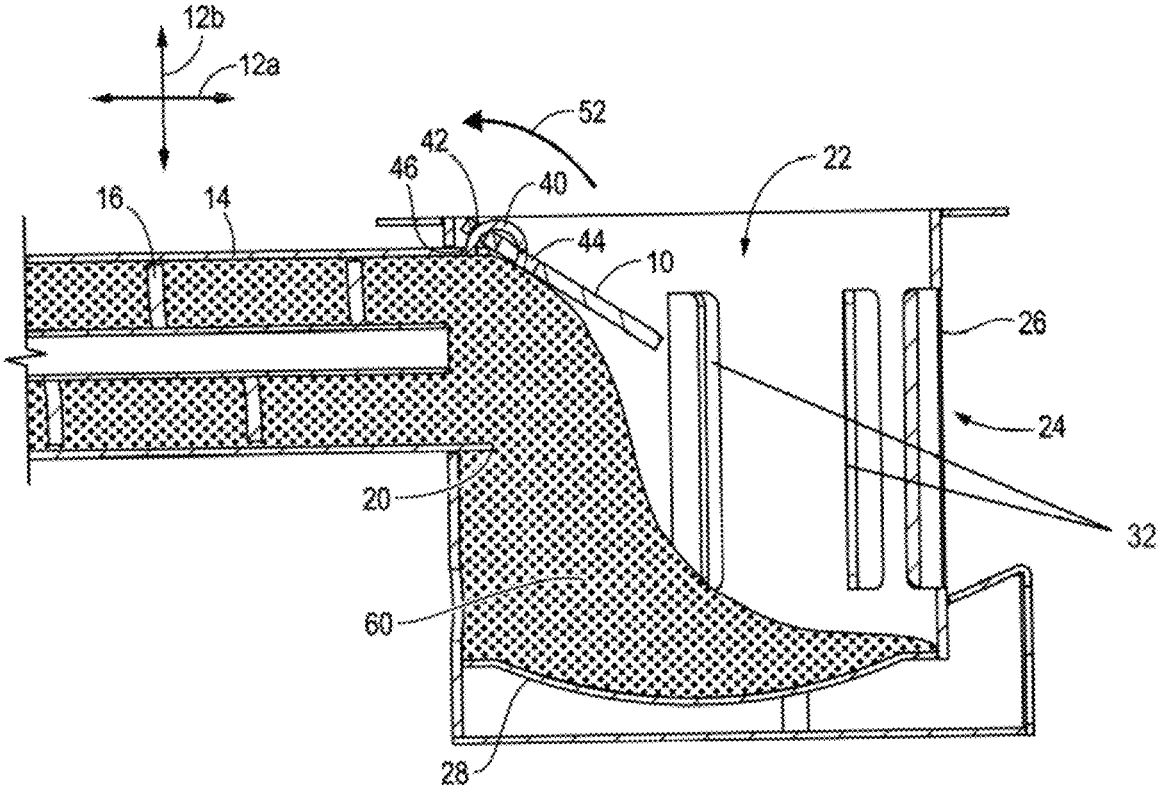
FIG. 8B is a detailed cross-sectional view of the auger flap in an open position, allowing the combustible material to be discharged into the burn box from the auger tube.

FIGS. 8A and 8B illustrate the operation of the auger flap 10. Referring specifically to FIG. 8A, when the auger 16 is not rotating and urging combustible material through the tube 14, the auger flap 10 is suspended from the loop 40 and compelled by gravity to lay substantially flat (e.g., within 2 degrees of flat) against the outlet end 20 of the tube 14.

Referring specifically to FIG. 8B, when combustible material 60 is forced by the auger 16 through the tube 14 into the inner volume 22 of the burn box 24, the combustible material 60 will force the auger flap 10 to pivot about the direction 52 and allow the combustible material 60 to fall from the outlet end 20 onto the bottom wall 28, where the combustible material 60 will be ignited by currently burning combustible material or an igniter. In some embodiments, the loop 40 itself may pivot upward slightly within the opening 46. Pivoting of the auger flap 10 may include the openings 42, 44 sliding along the loop 40, with the combined openings 42, 44 and the offset therebetween maintaining the auger flap 10 within a narrow range of motion (e.g., less than 5, less than 2, or less than 1 percent of the diameter of the tube 14) in the horizontal direction 12*c*.

When the auger 16 stops moving or combustible material 60 is no longer being forced through the tube 14 and any combustible material at the outlet end 20 has fallen into the inner volume 22, the auger flap 10 will be compelled by gravity to fall back to the position shown in FIG. 8A. The combined openings 42, 44 and the offset therebetween help guide the auger flap 10 back into the position of FIG. 8A rather than becoming stuck in some other position.

Figure 9:
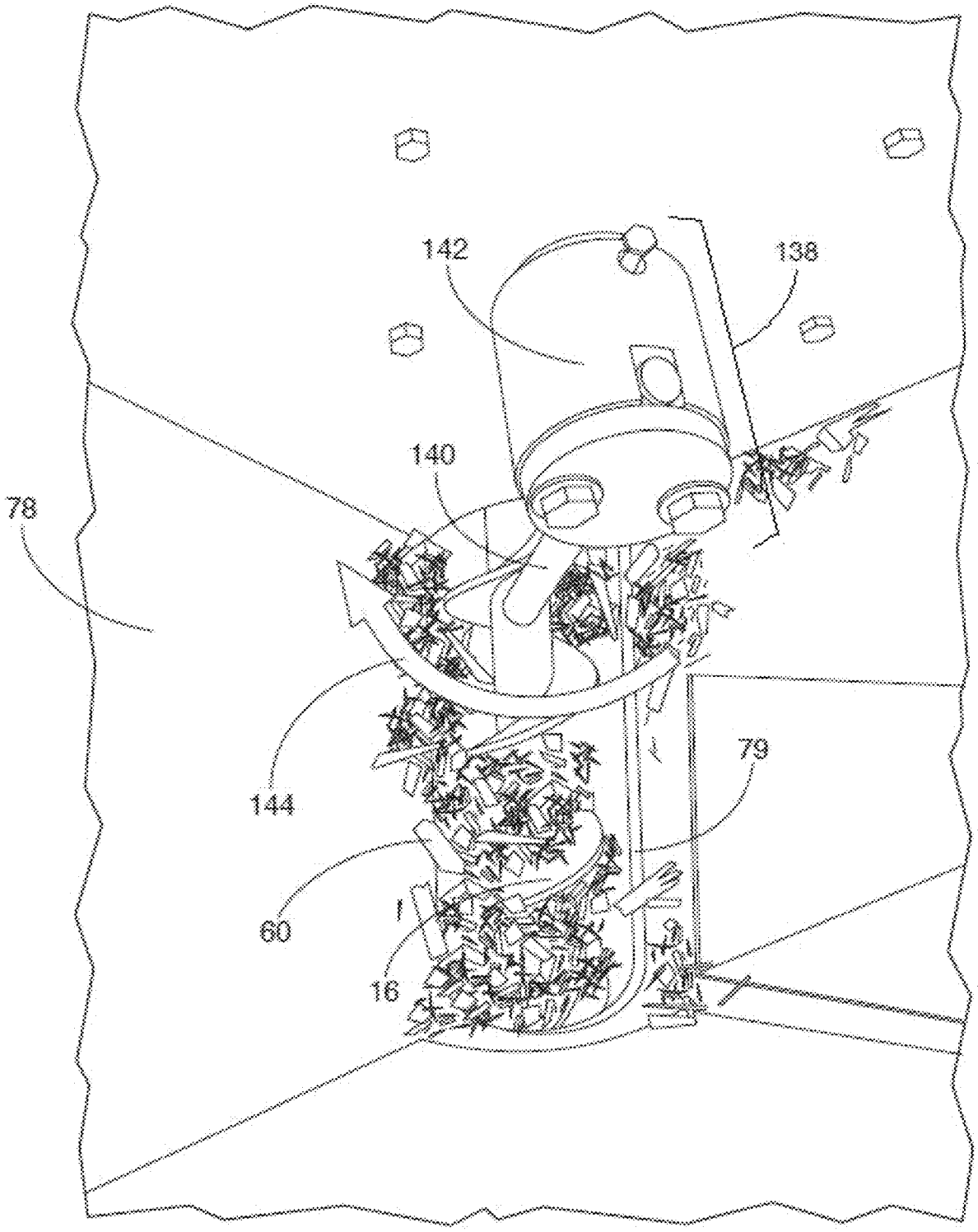
FIG. 9 is a perspective view of a programmable controlled clearing mechanism or agitator within the hopper illustrating rotating pins designed to prevent the bridging of combustible material above the auger.

Referring to FIG. 9, when using irregularly sized and shaped combustible material 60, for example wood chips (either conditioned or unconditioned) it is possible for the combustible material 60 to "bridge" above the auger 16. The combustible material may interlock to form a bridge above the auger 16 such that combustible material 60 no longer engages the auger 16 and is not fed through the tube 14. To prevent bridging, a clearing mechanism or agitator 138 may be used. In the illustrated embodiment, the clearing mechanism is one or more pins 140 that rotate over an opening 79 at the bottom of the hopper 78 through which the combustible material engages the auger 16 and enters the tube 14. The pin 140 may be connected to a clearing shaft 142 that rotates about an axis of rotation substantially (e.g., within 5 degrees of) parallel to the axis of rotation of the auger 16. The pin 140 may be cylindrical and orientated substantially (e.g., within 5 degrees of) perpendicular to the axis of rotation of the clearing shaft 142. The clearing shaft 142 may be driven by the motor 80 (see FIG. 2) through one or more gears and may rotate at a same or different speed from the auger 16. Alternatively, a separate motor (not shown) may drive the clearing shaft 142. A distal end of the pin 140 may traverse a path 144 over the opening 79. The path 144 may pass within 0.25, 0.125, or within 0.0625 inches of the auger 16. The distance between the axis of rotation of the clearing shaft 142 and the distal end of the pin 140 may be between 2 and 8 times the diameter 132 of the auger. However, smaller or larger distances may also be used. The programmable controller 102 can adjust the hopper agitator's operation and the speed of the auger's movement based on real-time monitoring of fuel flow, preventing blockages and optimizing fuel delivery.

Referring to FIGS. 1, 2, and 9, the programmable controller 102 regulates the various components of the cooker 90 to adapt to different fuel types, such as pellets, wood chips, and other irregularly sized combustible material, ensuring efficient fuel combustion and consistent heat output. The controller 102 is configured to manage the operation of the auger 16, hopper agitator 140, and fans 70 based on the type and size of the fuel being used. For instance, when wood chips or irregularly shaped combustible material 60 are selected, the controller 102 can adjust the auger's speed and the rotation of the clearing shaft 142 to prevent bridging, while simultaneously adjusting the airflow provided by the fans 70 to maintain optimal combustion conditions within the burn box 24. Additionally, the programmable system is capable of calculating the required fuel feed rate based on one or more of the real-time temperature readings of the ambient temperature, the temperature within the cooking chamber 94, and the type of fuel loaded into the hopper 78, as different fuels produce varying BTU outputs. For example, pellets may provide a higher BTU per pound compared to wood chips, which require a higher feed rate to maintain consistent temperatures. In some embodiments, sensors within the hopper 78 and burn box 24, together with the controller 102, can dynamically adjust the auger's feed rate to ensure the correct amount of fuel, air, is delivered to produce the required BTU content, compensating for changes in fuel type or size without user intervention. This adaptability enables the cooker 90 to operate efficiently across a variety of fuel sources, ensuring consistent cooking performance regardless of the fuel type used.

To account for variations in ambient temperature, fuel moisture, etc., a preferred embodiment of the present invention incorporates a Proportional Integral Derivative (PID) controller that compares the target temperature set by the user to the actual temperature in the cooking chamber 94 to calculate the proportional difference in temperature, the cumulative sum of past temperature error (the integral of the temperature error), and the rate of change of the difference between the target temperature and the actual temperature (the derivative of the temperature error).

Depending on the nature of the temperature error calculations determined by the PID, the programmable controller may adjust the speed of fuel and air inputs to dynamically maintain the target temperature without adjusting the input too rapidly, which could result in the combustion in the firebox to be extinguished. In the event the programmable controller detects the fire has been extinguished based on direct sensor readings, or calculations from the PID, a preferred embodiment of the present invention may be configured to activate the ignitor to reignite combustible material in the burn box 24.

Figure 10:
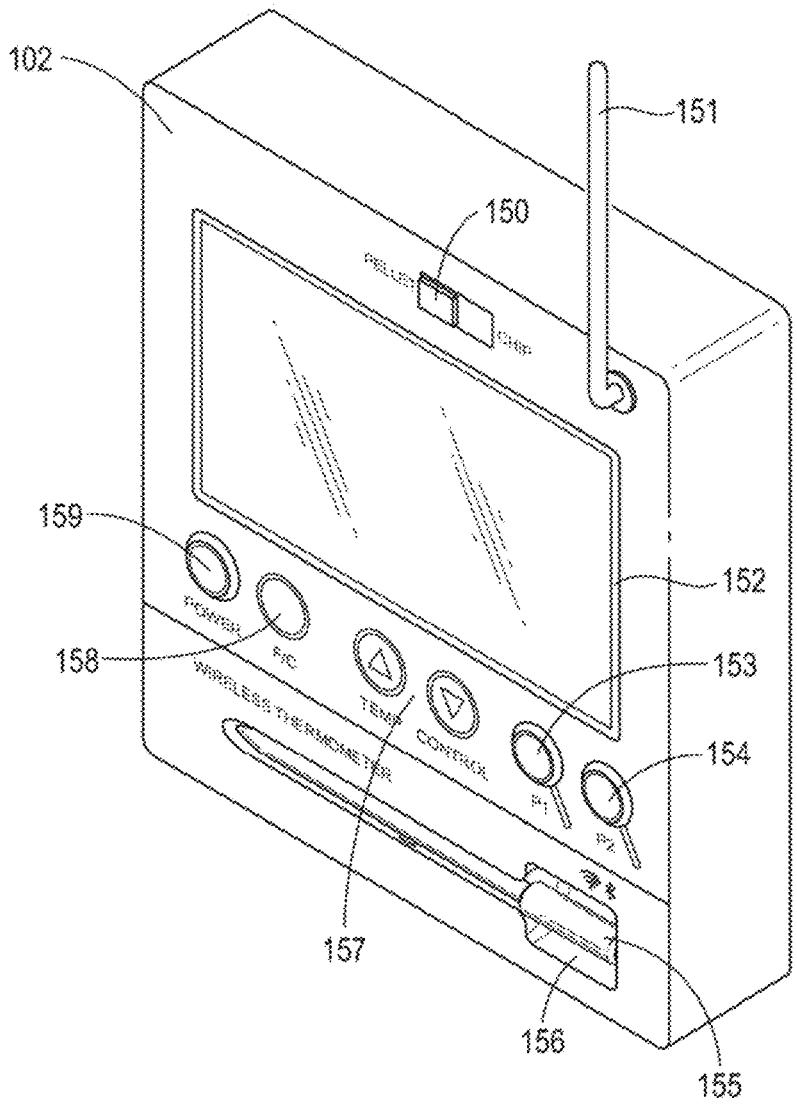
FIG. 10 is a perspective view of the programmable controller interface illustrating the user interface for managing invention operations.

Referring to FIG. 10, a preferred programmable controller 102 serves as the central hub for managing the present invention's operations and user interface. It includes a fuel type selector 150, allowing the user to choose between using wood chips or wood pellets, ensuring the variable fuel cooker adjusts its auger speed and airflow to optimize combustion and cooking temperature based on the selected fuel. A wireless connectivity antenna 151 enables WiFi or Bluetooth connectivity, allowing remote control and monitoring of the grill's performance via a dedicated application on a remote communication or computing device, such as a mobile device, notebook, tablet, wearable or similar technology. A display screen 152 provides real-time feedback on the grill's status, including temperature, fuel type, and other system settings.

The controller also preferably includes a probe 1 selector 153 and a probe 2 selector 154, which allow the user to display and manage the temperature readings from a wireless thermometer probe 155 that communicates with the cooker. Multiple wireless thermometer probes 155 can be paired to the cooker through a probe input slot 156, which is also designed to securely store the probe when not in use. A temperature selectors 157 allow precise adjustment of the grill's target cooking temperature, while a temperature unit selector 158 provides the option to switch between Celsius and Fahrenheit units. Finally, the controller may be operated by an on/off switch 159, providing easy power control for the entire system.

Figure 11:
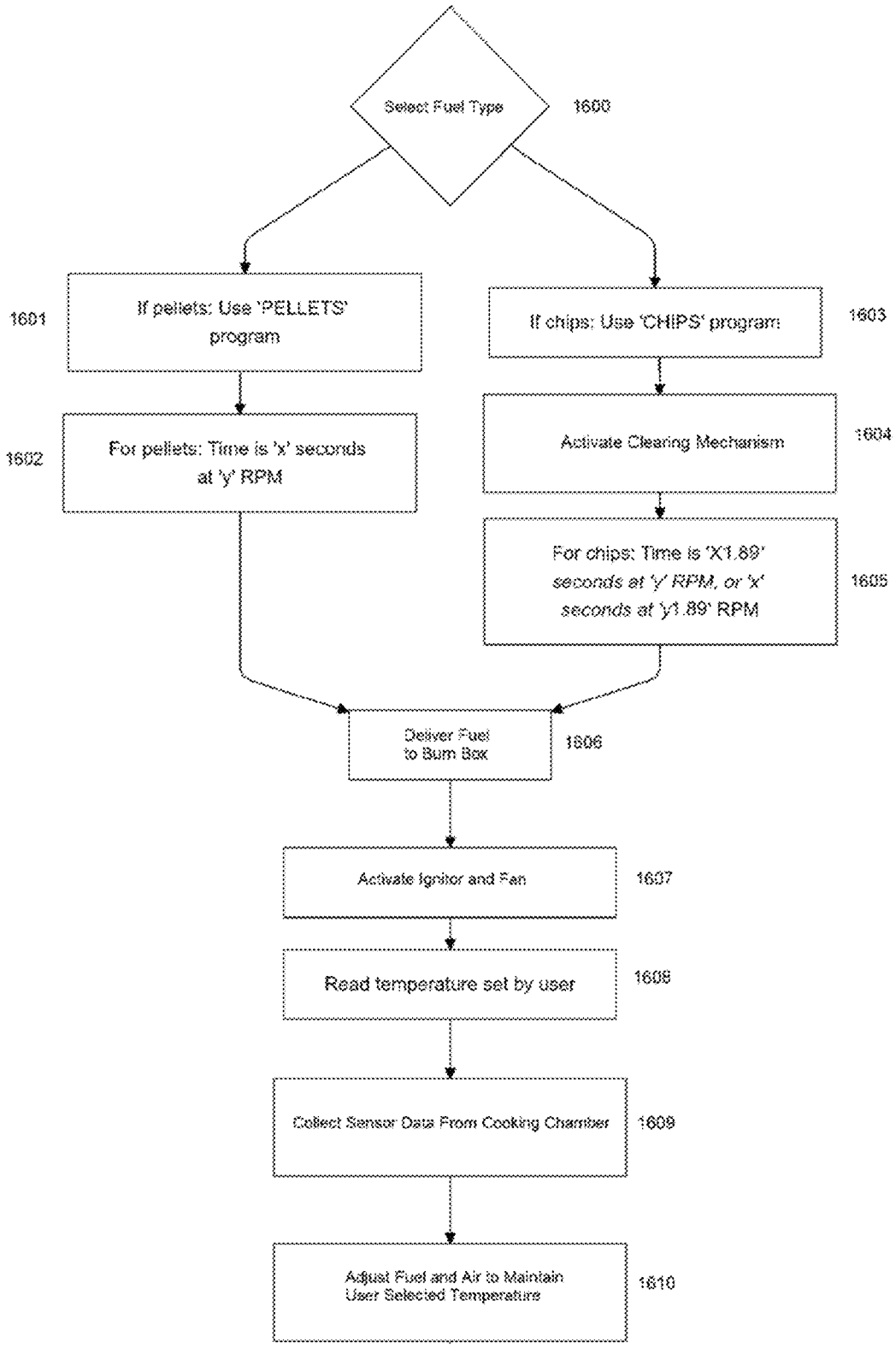
FIG. 11 is a flow chart illustrating a process for operating the present invention based on fuel type selection.

The controller or other part of the system (e.g., control housing 100) disclosed in the present invention further includes one or more microprocessors (not shown) coupled to or otherwise configured to actuate or control one or more system components, such as the hopper 78, fan 70, motors 72, 80, air chamber 74, auger tube 14, auger 16, and agitator 138 using instructions that are predetermined or dynamically established based on fuel type characteristics and other grill operation variables, as further described with reference to FIGS. 11.

FIG. 11 is a flow diagram of a process for operating the present invention based on fuel type selection according to some embodiments. The process begins at block 1600, where system receives an indication of a user selection of fuel type, either pellets or wood chips. Prior to or at the time of this operation, the user will have filled the hopper 78 with a predetermined and desire fuel type. This indication may be based on a manual entry by the user, for example via the fuel type selector 150. In alternative embodiments, the system may include one or more fuel type sensors (e.g., camera, scale, or other fuel type assessment device) that determine fuel type currently in the hopper 78 based on size, shape or other characteristic of the fuel. If pellets are selected, a Pellets program is activated at block 1601 and at block 1602, pellets are dispensed from the hopper 78, through the auger 16 for a time of x seconds at y rpm and delivered to the burn box 24 at block 1606. The time and rate of the auger 16 may vary based on, as examples only, the size of the cooking chamber 94 or the ambient temperature. If chips are selected a Chips program is activated at block 1603, activating the clearing mechanism at block 1604, and chips are dispensed from the hopper 78 through the auger 16 for a predetermined time of between 1.5× and 2.25×, or preferably (based on testing) 1.89× seconds at y rpm, or a time of x seconds at a rate of 1.89 rpm, and delivered to the burn box 24 at block 1606. The 1.89 multiple is optimized for commercially available chips, but may be adjusted to account for the relative density of various wood chips as measure by either the BTU content of the selected combustible material or the weight of the selected combustible material when accounting for the material's moisture content.

At block 1607, an ignitor in the burn box 24, and fan 70, feeding air into the burn box is activated to initiate combustion of the selected fuel. At block 1608, the cooker reads the temperature selector 157 setting, and at block 1609 collects temperature sensor data from the cooking chamber 94. If the temperature selector 157 setting does not align with the sensor data collected from the cooking chamber 94, at block 1610, the system adjusts the rate of fuel delivery through the auger 16 to the burn box 24, and/or the rate of air flow delivered to the burn box 24 by the fan 70, to maintain the selected temperature. If the temperature in the cooking chamber 94 is too low the rate of fuel and air delivery to the burn box 24 may be increased. And if the temperature is too high, the rate of fuel and air delivery to the burn box 24 may be decreased.

In a preferred embodiment, when the fuel type selector 150 is triggered by the user at block 1600, the programmable controller will maintain the prior rate of fuel delivery to the burn box 24 for approximately 3 minutes, or until the auger 16 has completed sufficient rotations to fully dispense combustible material retained in the auger tube 14, prior to engaging either the newly selected Pellets program at 1601, or the newly selected Chips program at 1603. In other embodiments the calculations from the PID controller will cause the programmable controller to dynamically adjust the feed rate of combustible material until the prior fuel contained in the auger tube 14 has been dispensed to the burn box 24 and replaced by the newly selected fuel type contained in the hopper 78.

Various methods exist for calculating BTU content for different fuels, including based on weight or volume. For example, one pound of hardwood pellets, or about 0.025 cu ft of pellets, adjusted for moisture content, produces about ~7,900 BTUs. One pound of hardwood chips, or about 0.043 cu ft of chips, adjusted for moisture content, produces about 7,300 BTUs. An alternative embodiment of the present invention may incorporate a scale or volume measurement feature in the hopper that weighs or measures fuel before moving it into the auger and subsequently the burn box, and the rate can be calculated based on such measurements.

The maximum size of the chip is a mathematical function of the auger tube diameter, auger diameter, pitch (distance the product moves during one revolution of the auger), and motor torque. In one example, the largest chip a 2 inch diameter auger tube could accommodate would theoretically be 1.99999 inches, but the motor torque required to move this through the tube would be astronomical. After experimentation, it was determined that a 25 nm (newton-meter or 18.44 ft-lbs.) motor will reliably deliver chips as large as ¾ inch diameter through a 2 inch diameter auger tube to the burn box. However, it should be understood that different auger tube sizes may be used depending on the specific fuel characteristics.

In a preferred operation of the present invention, wood chips are dried to below 20% moisture content, and preferably about 15% moisture content, in order to let the steam produced when burning the wood chips to permeate the food and condition it to a much moister result. This 15% moisture content is well below the "mold threshold" of between 20% and 27%, which is generally understood to be a range that is safe from fungal infection. Accordingly, the optimum rate for dispensing fuel is in part a function of the moisture content of the fuel. For example, if for wood chips the moisture content is 0% (meaning the chips are 100% dry), a preferred rate may be 1.76× seconds at y rpm, or a time of x seconds at a rate of 1.76 rpm, instead of 1.89× if the moisture content is 15%. Note that a different rate will still work (for example 1.76× used with 0% moisture content), although it would take longer to reach the desired temperature.

The controller calculates the quantity of fuel needed by starting with which fuel type selected-Pellets or Chips. Pellets produce ~183 BTUs per cubic inch. Wood chips produce ~97 BTUs per cubic inch. A typical 30,000 BTU pellet grills (this means 30,000 BTUs per hour) will need to put 164 cubic inches of pellets per hour (2.73 cu. in. per minute) or 309 cubic inches of wood chips per hour (5.14 cubic inches per minute) into the burn box, ignoring ambient temperatures. Colder ambient temps will require increased BTUs, as hotter ambient temperatures will require decreased BTUs. The standard measurements of BTUs for any combustible are done at 20° C. (68° F.), so variations from this temperature will result in lower or higher BTU production. For this reason, a preferred embodiment includes a sensor that measures ambient temperature, and the system adjusts the fuel and air flow rate depending on the measured ambient temperature. The number of turns of the auger and the RPMs necessary to transport the required amount of fuel into the burn box is readily calculated once ambient temperate and fuel type are known. Accordingly, the sensor, reading the AT (Actual Temperature) information, will feed this information to the controller, which will adjust (for now anyway) the feed rate proportionally (mathematically) to attain the desired temperature. Of course, there are guiderails, as this rate cannot be so high as to pack the burn box with fuel, which would extinguish the fire.

Further, the system adjusts the rate depending on changes to the desired burn box (grill surface) temperate. Preferably, the system changes the temperature gradually in order that the fire does not go out. The rate of change should be modulated to a much lower one in order to prevent this result. So whereas a temperature increase can be rapid by transporting a higher quantity of fuel into the burn box, it is not possible to simply stop transporting fuel into the burn box to lower the temperature. Through experimentation, the minimum rate of fuel and air flow required to prevent the fire from going out across a wide range of ambient temperatures as measured by the ambient temperature sensor has been determined and incorporated.

The process of FIG. 11 and the other processes or functions described herein may be performed at least in part by conventional computer hardware and software arrangements. For example, the described processes may be performed by the microprocessors (not shown), which may include a memory, central processing unit ("CPU"), input/output devices or ports, and the like. Memory may be or include any computer-readable media, including as volatile or non-volatile memory, such as RAM, ROM, Flash memory, magnetic storage, optical storage, and the like. Some embodiments may store in memory instructions or other contents that are configured, when executed by a CPU or other processing unit, to perform one or more of the described processes. Some embodiments may implement one or more of the described processes by way of fixed or configurable hardware arrangements including as application specific integrated circuits, field-programmable gate arrays, programmable logic arrays, or the like.

It should be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "includes," "including," "comprises," and "comprising" should be interpreted as referring to elements, components, or steps in a non-exclusive manner, indicating that the referenced elements, components, or steps may be present, or utilized, or combined with other elements, components, or steps that are not expressly referenced. Where the written description and/or claims refer to at least one of something selected from the group consisting of A, B, C . . . and N, the text should be interpreted as requiring at least one element from the group (A, B, C . . . N), rather than A plus N, or B plus N, etc.

While the preferred embodiment of the invention has been illustrated and described, as noted above, many changes can be made without departing from the spirit and scope of the invention. Accordingly, the scope of the invention is not limited by the disclosure of the preferred embodiment. Instead, the invention should be determined entirely by reference to the claims that follow.

The embodiments of the invention in which an exclusive property or privilege is claimed are defined as follows:

1. A device for delivering and burning variable combustible material selected from a group consisting of wood pellets or wood chips, comprising:

a hopper for holding the combustible material;

a burn box to receive and burn the combustible material;

a programmable auger, pivotably connected within an auger tube to facilitate adjustment of an auger's orientation within the auger tube in response to irregularly sized or shaped combustible material, through which the combustible material is moved from the hopper to the burn box; and a microprocessor configured to receive selection of a fuel type of combustible material, wherein after receipt of the fuel type selection the microprocessor is further configured to adjust one or more of the airflow into the burn box or the feed rate of the combustible material at a higher speed for wood chips than wood pellets to facilitate burning of the combustible material.

2. The device of claim 1, wherein the microprocessor is configured to adjust the feed rate of the auger at a rate between 1.5 and 2.25 times higher speed for wood chips than wood pellets.

3. The device of claim 1, further comprising a fan, wherein the microprocessor is configured to control the fan to adjust airflow into the burn box to facilitate burning of the combustible material.

4. The device of claim 3, wherein the microprocessor is further configured to dynamically adjust the speed of the fan in response to real-time temperature data from a sensor positioned within a cooking chamber.

5. The device of claim 1, further comprising a programmable wood conditioner position between the hopper and the auger that is activated if wood chips are the combustible material.

6. A device for delivering and burning variable combustible material, comprising:

a hopper for holding the combustible material;

a burn box to receive and burn the combustible material;

a programmable auger, pivotably connected within an auger tube to facilitate adjustment of an auger's orientation within the auger tube in response to irregularly sized or shaped combustible material, through which the combustible material is moved from the hopper to the burn box;

a programmable agitator coupled to the hopper and configured to engage the combustible material as it leaves the auger; and a microprocessor configured to receive selection of a fuel type of combustible material, wherein after receipt of the fuel type selection the microprocessor is further configured to adjust one or more of the airflow into the burn box or the feed rate of the combustible material to facilitate burning of the combustible material.

7. The device of claim 6, wherein the microprocessor is configured to engage the agitator when the combustible material fuel type is wood chips.

8. A method for controlling a device configured to use at least two different combustible material fuel types, the method comprising:

receiving selection of a fuel type of combustible material;

loading a hopper with a combustible material;

transporting the combustible material from the hopper to a burn box via an auger running between the hopper and the burn box;

adjusting the auger's orientation within an auger tube in response to irregularly sized or shaped combustible material to facilitate transportation of the combustible material from a hopper to a burn box; and adjusting one or more of the airflow into the burn box or the feed rate of the combustible material to facilitate burning of the combustible material, wherein the feed rate is between 1.5 and 2.25 times higher speed for wood chips than wood pellets.

9. The method of claim 8, further comprising agitating the combustible material using an agitator coupled to the hopper and configured to engage the combustible material as it leaves the auger.

10. The method of claim 8, wherein the airflow into the burn box is adjusted by modifying the speed of a fan to facilitate burning of the combustible material.

11. The method of claim 10, wherein the speed of the fan is dynamically adjusted in response to real-time temperature data from a sensor positioned within a cooking chamber.

12. The method of claim 8, wherein adjusting one or more of the airflow into the burn box or the feed rate of the combustible material to facilitate burning of the combustible material occurs via remote wireless connectivity.

13. The method of claim 8, further comprising monitoring a temperature of the combustible material burning in the burn box.

14. The method of claim 13, wherein monitoring a temperature of the combustible material burning in the burn box occurs via remote wireless connectivity.

* * * * *